United States Patent [19]

Iijima et al.

[11] Patent Number: 4,990,437

[45] Date of Patent: Feb. 5, 1991

[54] SILVER HALIDE PHOTOGRAPHIC LIGHT-SENSITIVE MATERIAL

[75] Inventors: Toshifumi Iijima, Kokubunji; Kenji Kumashiro; Syoji Matsuzaka, both of Hachioji; Hiroshi Kashiwagi, Hino, all of Japan

[73] Assignee: Konishiroku Photo Industry Co., Ltd., Tokyo, Japan

[21] Appl. No.: 370,105

[22] Filed: Jun. 20, 1989

Related U.S. Application Data

[63] Continuation of Ser. No. 857,071, Apr. 29, 1986, abandoned.

[30] Foreign Application Priority Data

Apr. 30, 1985 [JP] Japan ..... 60-92690

[51] Int. Cl.[5] ..... G03C 7/38; G03C 1/005

[52] U.S. Cl. ..... 430/558; 430/567

[58] Field of Search ..... 430/558, 567, 569

[56] References Cited

U.S. PATENT DOCUMENTS

| | | | |
|---|---|---|---|
| 2,592,250 | 4/1952 | Davey et al. . | |
| 3,632,373 | 1/1972 | O'Connell et al. . | |
| 3,725,067 | 4/1973 | Bailey et al. . | |
| 4,075,020 | 2/1978 | Saleck et al. . | |
| 4,477,564 | 10/1984 | Cellone et al. | 430/567 |
| 4,614,711 | 9/1986 | Sugimoto et al. | 430/567 |
| 4,636,461 | 1/1987 | Becker et al. | 430/567 |
| 4,692,400 | 9/1987 | Kumashiro et al. | 430/553 |
| 4,705,743 | 11/1987 | Mihayashi et al. | 430/385 |
| 4,713,318 | 12/1987 | Sugimoto et al. | 430/567 |

FOREIGN PATENT DOCUMENTS

| | | | |
|---|---|---|---|
| 0121435 | 10/1984 | European Pat. Off. | 430/567 |
| 0202784 | 11/1986 | European Pat. Off. | 430/567 |
| 0247474 | 12/1987 | European Pat. Off. | 430/567 |
| 1810464 | 7/1969 | Fed. Rep. of Germany . | |
| 3310609 | 10/1983 | Fed. Rep. of Germany . | |
| 3404854 | 8/1985 | Fed. Rep. of Germany | 430/567 |
| 0250643 | 11/1986 | Japan | 430/567 |
| 2058246 | 3/1987 | Japan | 430/567 |
| 1247493 | 9/1971 | United Kingdom . | |
| 1252418 | 11/1971 | United Kingdom . | |
| 1334515 | 10/1973 | United Kingdom . | |

OTHER PUBLICATIONS

Research Disclosure, No. 245, Sep. 1984, pp. 442–454, No. 24531, Havant, Hampshire, Great Britain, "Image—Forming Process".

European Search Report EP 86 10 5907.

*Primary Examiner*—Paul R. Michl

*Assistant Examiner*—Lee C. Wright

*Attorney, Agent, or Firm*—Finnegan, Henderson, Farabow, Garrett & Dunner

[57] ABSTRACT

A silver halide photographic light-sensitive materially having at least one silver halide emulsion layer comprising a magenta coupler represented by formula I and negative type silver halide grains having a core-shell structure which consists of:

(a) an inner core consisting essentially of silver bromide or silver iodobromide; and (b) a plurality of shells consisting essentially of silver bromide or silver iodobromide comprising:

(i) an outermost shell containing 0 to 10 mol % of silver iodide;

a high iodide-containing shell provided inside said outermost shell having a silver iodide content at least 6 mol % higher than that of the outermost shell; and (iii) an intermediate shell provided between the outermost shell and the high iodide-containing shell having a silver iodide content at least 3 mol % higher than that of the outermost shell, and at least 3 mol % lower than that of the high iodide-containing shell:

(I)

Wherein Z represents a group of non-metallic atoms necessary to complete a nitrogen-containing heterocyclic ring, X represents a hydrogen atom, a halogen atom or a releasable group, and R represents a hydrogen atom, a halogen atom or a monovalent group.

33 Claims, No Drawings

SILVER HALIDE PHOTOGRAPHIC LIGHT-SENSITIVE MATERIAL

This application is a continuation of application Ser. No. 06/857,071, filed Apr. 29, 1986, now abandoned.

BACKGROUND OF THE INVENTION

This invention relates to a silver halide photographic light-sensitive material.

Heretofore, in the field of a silver halide photographic light-sensitive material, a 5-pyrazolone type coupler has popularly been used for a magenta dye image coupler. However, this kind of couplers cannot avoid unnecessary secondary absorption because they have a yellow component around 430nm and this phenomenon has sometimes caused a color turbidity. Accordingly, for the purpose of solving the color turbidity problems, there have been the proposals of the 1H-pyrazolo[3,2-C]-S-triazole type couplers, (namely, a coupler comprising an 1H-pyrazolo[3,2-C]-S-triazole derivative), (Refer to U.S. Pat. No. 3,725,067; British Patent Nos. 1,252,418 and 1,334,515; and Japanese Patent No. O.P.I. Publication Nos. 99437/1984 and 228252/1984). With this type of couplers, the above-mentioned problems may be solved, because such couplers may be able to avoid nearly all of the unnecessary secondary absorption. In some coupler, the color density thereof may sometimes be lowered by formalin (which is used as an insecticide to furnitures and the like). In contrast with such a coupler, this type of couplers have the advantages that the density lowering is substantially less in a formalin atmosphere and the preservation thereof may easily be made and further the sensitivity thereof is high.

On the other hand, it was found that this type of couplers have such undesirable photographic characteristics as that fogs are increased or the sensitivity is lowered at a high temperature and during a long lapse of time before the couplers which were mixed with an emulsion are coated on a film surface and dried.

U.S. Pat. No. 3,632,373 and Japanese Patent No. O.P.I. Publication No. 212092/1984 each disclose such a means that a coating solution stability is to be improved in such a manner that an emulsion and a dispersed liquid are mixed up together immediately before coating the resulted mixture on and the mixture is coated on and dried up. These means are still not fully satisfied and have been unable to improve the above-mentioned stability particularly in a high temperature preservation of film.

In recent years, as there have been more strict requirements for silver halide emulsions for photographic use, so have increased the demands for the high-level photographic characteristics such as a high-speed, an excellent graininess, a clear-cut sharpness, a low fog-density, a sufficiently wide exposure range and so on.

There have been the well-known high-speed emulsions such as a silver iodobromide emulsion containing iodide in an amount of from 0 to 10 mol % of the emulsion, to satisfy the above-mentioned requirements. About the processes of preparing the above-mentioned emulsions, there have so far been the well-known processes including, for example, an ammonia process, a neutral process, such a process as an acid process in which the conditions of pH and pAg values are controlled, and such a precipitation process as a single-jet or double-jet process.

Based upon the above-mentioned prior art and with the purposes of making the sensitivity of light-sensitive materials higher and improving the graininess thereof and, further, achieving both of the high sharpness and low fog thereof, the technical means have so far been researched with an utmost precision and have then been put into practice. A silver iodobromide emulsion which is an object of the invention have been studied so as to control not only the crystal habits and grain distribution but also the iodide density distribution in an individual silver halide grain.

For realizing the photographic characteristics including, for example, a high speed, excellent graininess, high sharpness or low fog density, the most orthodox process therefor is to improve the quantum efficiency of a silver halide used. For realizing this purpose, the observation of solid state physics and the like have positively been adopted.

There are the researches in which the above-mentioned quantum efficiency was theoretically computed and the influence on a graininess distribution was also studied. One of the researches is described in, for example, the preprints of 1980 Tokyo Symposium on Photographic Progress, titled 'Interactions Between Light and Materials', p. 91. This research predicts that a quantum efficiency could effectively be improved if a monodispersed emulsion may be prepared by narrowing a grain distribution. Further, in the so-called chemical sensitization process for sensitizing a silver halide emulsion (This process will be described in detail later.), it may be reasonably presumed that a monodispersed emulsion may also be advantageous to effectively make a light-sensitive material highly sensitive with keeping a low fog level.

For industrially preparing such a monodispersed emulsion, it is desired, as described in Japanese Patent Publication Open to Public Inspection (hereinafter called Japanese Patent No. O.P.I. Publication) No. 48521/1979, to apply both of the theoretically predetermined conditions of the feeding rate controls of silver ions and silver halide ions to be fed into a reaction system and the satisfactory conditions of the agitation thereof to the preparation process under the strict controls of the pAg and pH values of the emulsion. When a silver halide emulsion is prepared under the above-mentioned conditions, it is in either one of the cubic, octahedral and tetradecahedral crystal forms. That is to say, such an emulsion comprises the so-called normal crystal grains each having both of the (100) and (111) planes in various ratios. It is well-known that a high sensitization may be achieved by making use of the above-mentioned normal crystal grains.

Meanwhile, it has so far been well-known that the silver halide emulsions suitably used in high speed photographic films include a silver iodobromide emulsion comprising polydispersed type twinned crystal grains.

Also, silver iodobromide emulsions each containing tabular shaped twinned crystal grains are disclosed in, for example, Japanese Patent O.P.I. Publication No. 113927/1983 and others.

On the other hand, Japanese Patent O.P.I. Publication No. 22408/1978; Japanese Patent Examined Publication No. 13162/1968; 'Journal of Photographic Science', No. 24, p. 198, 1976; and the like each describe, respectively, that a development activity is increased or a high sensitization is realized by making use of multilayered type silver halide grains applied with a plurality of shells on the outside of the inner cores of the grains.

Further, West German Patent No. 2,932,650; Japanese Patent O.P.I. Publication Nos. 2417/1976, 17436/1976 and 11927/1977; and the like describe the respective silver halide grains each provided with a covering layer through a halogen substitution so as to serve as the outermost layer of the silver halide grain. These silver halide grains are practically unable to serve as any negative type emulsion, because a fixing time may be shortened thereby, however, to the contrary, a development may be thereby inhibited, so that a satisfactory sensitivity may not be obtained.

There is also well-known positive type (i.e., an internal latent image type) silver halide grains each provided outside the inner core thereof with a plurality of covering layers prepared through a halogen substitution, of which are described in, for example, U.S. Pat. Nos. 2,592,250 and 4,075,020; and Japanese Patent O.P.I. Publication No. 127549/1980. These silver halide grains are often used in an internal latent image type direct positive light-sensitive material such as those for diffusion transferring use. However, they cannot be used at all in any negative type emulsion to which the invention directed, because the internal sensitivity thereof is excessively high from the very nature of things.

There is a further silver halide grain provided on the inner core thereof with shells, as described above, and in which various iodide contents of the respective layers thereof are taken into account. This type of grains are described in, for example, Japanese Patent O.P.I. Publication Nos. 181037/1983, 35726/1985 and 116647/1984.

In the field of silver halide photographic light-sensitive materials, color light-sensitive materials each having an ISO speed of 1000 or over have recently been introduced, thanks to the various technical progress. It is, however, usual that such a light-sensitive material is deteriorated in graininess and sharpness as it becomes higher in sensitivity, and such a high speed light-sensitive material is yet very unsatisfactory for the consumers who want to admire a good photograph because its image quality is not good enough as compared with those of a conventional light-sensitive material. Therefore, a high-speed negative type light-sensitive material excellent in graininess and image sharpness has so far been demanded.

For astronomical photography, indoor photography, sport photography and the like, a further high-speed negative type light-sensitive material has particularly been demanded.

SUMMARY OF THE INVENTION

It is an object of the invention to provide a negative type silver halide photographic light-sensitive material which is excellent in preservability and stability on liquid-state standing in the course of preparing an emulsion containing a pyrazoloazole type magenta coupler; excellent in harmful-gas resistance; excellent in high-sensitivity and relation between sensitivity and fog; broad in exposure range; and excellent in graininess and sharpness.

A silver halide photographic light-sensitive material having at least one silver halide emulsion layer, wherein the silver halide emulsion layer comprises a magenta coupler represented by the general formula [I ] and a negative type silver halide grains of a core-shell structure which consists of an inner core essentially consisting of silver bromide or silver iodobromide and a plurality of shells essentially consisting of silver bromide or silver iodobromide, and the plurality of shells comprises an outermost shell containing 0 to 10 mol % of silver iodide, a high iodide-containing shell provided inside said outermost shell of which silver iodide content is at least 6 mol % higher than that of the outermost shell, and an intermediate shell provided between the outermost shell and the highly iodide-containing shell of which a silver iodide content is at least 3 mol % higher than that of the outermost shell, and at least 3 mol % lower than that of the highly iodide-containing shell:

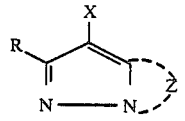

[I]

(wherein Z represents a group of non-metal atoms necessary for complete a nitrogen-containing heterocyclic ring which may have a substituent, X represents a hydrogen atom, halogen atom or monovalent group which is, upon reaction with an oxidation product of a color developing agent, capable of being released from the coupler residue and R represents a hydrogen atom, a halogen atom or a monovalent group.

DETAILED DESCRIPTION OF THE INVENTION

In the silver halide composition of the silver halide grains relating to the invention, the above-mentioned expression, 'substantially comprising . . .', means that the silver halide composition is allowed to contain other silver halide than silver bromide or silver iodobromide, such as silver chloride and, more particularly, silver chloride having a proportion of not more than 1 mol % is desired.

The special features of the photographic light-sensitive materials of the invention may be summarized as given below:

(1) A high-speed, a wide exposure range and an excellent graininess (as compared with non-core/shell type emulsions) may be obtained by making use of emulsion containing core/shell type silver halide grains each provided to the inside thereof with highly iodide-containing shells;

(2) A further high-speed may be obtained by interposing an intermediate shell between the highly iodide-containing shell and the outermost low iodide-containing shell, provided that the iodide content of the intermediate shell is in an amount between that of the low iodide-containing shell and that of the outermost shell.;

(3) A preferable iodide content of the highly iodide-containing shell is from 6 to 40 mol % and is made not less than 6 mol % higher than the outermost shell. If the iodide content thereof is less than 6 mol % (or, if it is less than 6 mol % only higher than that of the outermost shell), the sensitivity of a light-sensitive material is lowered. To the contrary, if it exceeds 40 mol %, the light-sensitive material is polydispersed. It is, therefore, preferred from the viewpoint of the sensitivity and the image sharpness that the iodide content of a highly iodide-containing shell may not exceed 40 mol %.

(4) The difference between the iodide content of an intermediate shell and that of the outermost shell or that of a highly iodide-containing shell shall not be less than 3 mol %, respectively. Because, if the difference is too little, the advantages of the intermediate shell are reduced. (i.e., the sensitivity of a light-sensitive material is lowered.) From the viewpoint of that the advantages of the intermediate shell (in sensitivity, monodispersibility, fog-sensitivity correlation and image sharpness) are effectively induced, it is preferred to specify the upper limit of the difference between these iodide contents up to 35 mol %.

(5) When the iodide content of the whole silver halide grains is in excess, the developability and sensitivity of a light-sensitive material tend to be lowered, while it is in short, the gradation tends to be too hard and the exposure range narrowed and further the graininess worsened. It is, therefore, preferred to choose a suitably specified range of iodide contents.

(6) A monodispersed emulsion is superior to a polydispersed emulsion in sensitivity, sharpness and the correlation between fogginess and sensitivity. That is to say, in such polydispersed emulsions, an ideal core/shell structure may hardly be formed, because the shell-forming reactions thereof are not uniform; and fine grains are present therein so as to deteriorate the sharpness; and, further, the sensitivity thereof is lowered and the correlation between fogginess and sensitivity tends to be worsened, because the optimum conditions for chemically sensitizing the emulsion after the grains thereof were formed depend upon the individual grains. Therefore, the monodispersed emulsions are preferably used instead.

(7) When a light-sensitive material is multilayered, the multilayer-sensitivity thereof will be inferior to a monolayer-sensitivity. (This phenomenon is called an interlayer desensitization effect.) The emulsions of the invention is not only high in sensitivity of the monolayer thereof but also hardly be affected by the above-mentioned interlayer desensitization effect. Therefore, the emulsions of the invention may effectively be used in such multilayered color light-sensitive materials.

(8) If the core/shell type silver, halide grains of the invention are combined with the above-mentioned magenta couplers, the stability of the emulsions containing the same couplers may be improved. This will be described later.

For the purpose of further improving the above-mentioned excellent effects in the following terms;

Ih: An iodide content of a highly iodide-containing shell (mol %);

Im: An iodide content of an intermediate shell (mol %); and

Il: An iodide content of an outermost shell (mol %); it is preferred to provide $\Delta I = Ih - Il > 8$ mol %, $\Delta Ih = Ih - Im > 4$ mol % and $\Delta Il = Im - Il > 4$ mol %; and it is further preferred to provide $\Delta Il > 10$ mol %, $\Delta Ih > 4$ mol % and $\Delta Il > 4$ mol %; wherein Il is preferably from 0 to 5 mol % and, more preferably, from 0 to 2 mol % and, further preferably, from 0 to 1 mol %; and Ih is preferably from 6 to 40 mol % and, more preferably, from 10 to 40 mol %.

Further, the volume of an outermost shell is preferably from 4 to 70% of a whole grain and, more preferably, from 10 to 50% thereof. The volume of a highly iodide-containing shell is preferably from 10 to 80% of a whole grain and, more preferably, from 20 to 50% and, further preferably, from 20 to 45% thereof. The volume of an intermediate shell is preferably from 5 to 60% of a whole grain and, more preferably, from 20 to 55% thereof.

An iodide content of a highly iodide-containing shell is preferably from 6 to 40 mol % and, more preferably, from 10 to 40 mol %. Such highly iodide-containing shell may be at least one part of an inner shell and, more preferably, a separate inner shell is to be provided to the inner side of the highly iodide-containing shell.

The iodide content of such an inner core is preferably from 0 to 40 mol % and, more preferably, from 0 to 10 mol % and, further preferably, from 0 to 6 mol %. The grain size of such an inner core is preferably from 0.05 to 0.8 μm and, more preferably, from 0.05 to 0.4 μm.

The iodide content of a whole grain is preferably from 1 to 20 mol % and, more preferably, from 1 to 15 mol % and, further preferably, from 2 to 12 mol %. The grain size distribution is allowed to be either one of the polydisperse type and the monodispere type. However, variation coefficient of such grain size distribution is preferably not more than 20% in a monodispersed emulsion and, more preferably, not more than 15%. Such a variation coefficient will be defined as follows to measure a monodispersibility:

$$\text{Variation coefficient (\%)} = \frac{\text{Standard deviation of grain size}}{\text{Average grain size}} \times 100$$

invention will further be described below:

An inner core and a highly iodide-containing shell may be the same, or the such inner core may separately be provided to the inside of the highly iodide-containing shell. An inner core and a highly iodide-containing shell, the highly iodide-containing shell and an intermediate shell, and the intermediate shell and the outermost shell are allowed to be adjacent to each other; and, in addition, it is also allowed that another shell comprising at least one layer having an arbitrary composition (hereinafter called an arbitrary shell) may be interposed between the above-mentioned shells.

The above-mentioned arbitrary shell may be any one of a monolayered shell having a uniform composition, a group of the shells which comprises a plurality of shells each having a uniform composition and changes its composition stepwise, a continuous shell which changes its composition continuously in its arbitrary shell, and the combination thereof. The above-mentioned highly iodide-containing shell and intermediate shell may be used plurally or in only a pair.

Next, the examples of the layer arrangements of the silver halide grains relating to the invention will now be described:

Wherein, an iodide content will be represented by I and a subscript represents an order of a shell.

1. 3-layer structure of an inner core = a highly iodide-containing shell:

| | iodide content | Shell diameter |
|---|---|---|
| Core (3rd) (Inner core = Highly iodide-containing shell) | | |
| $I_3 - I_2 > 3$ mol % | $I_3 = 15$ mol % | 1.2 μm |
| 2nd shell (Intermediate shell) | | |
| $I_2 - I_1 > 3$ mol % | $I_2 = 5$ mol % | 1.4 μm |
| 1st shell (Outermost shell) | | |
| $I_1 = 0 \sim 10$ mol % | $I_1 = 0.5$ mol % | 1.6 μm |

2. 6-layer structure interposing the 4th and 5th shells each having an arbitrary composition between an inner core and a highly iodide-containing shell:

| | iodide content | Shell diameter |
|---|---|---|
| Core (6th) (Inner core) | | |
| Arbitrariness | $I_6 = 4.0$ mol % | 0.1 μm |

-continued

| | iodide content | Shell diameter |
|---|---|---|
| 5th shell (—) | | |
| Arbitrariness | $I_5$ = 2.0 mol % | 0.27 μm |
| 4th shell (—) | | |
| Arbitrariness | $I_4$ = 2.6 mol % | 0.8 μm |
| 3rd shell (Highly iodide-containing shell) | | |
| $I_3$–$I_2$ > 3 mol % | $I_3$ = 15.0 mol % | 1.12 μm |
| 2nd shell (Intermediate shell) | | |
| $I_2$–$I_1$ > 3 mol % | $I_2$ = 5.0 mol % | 1.44 μm |
| 1st shell (Outermost shell) | | |
| $I_1$ = 0 ~ 10 mol % | $I_1$ = 0.5 mol % | 1.6 μm |

3. 7-layer structure interposing the 5th and 6th shells between an inner shell and a highly iodide-containing shell and also interposing a 2-layered intermediate shell between the outermost shell and the highly iodide-containing shell:

| | iodide content | Shell diameter |
|---|---|---|
| 7th shell (Inner core) | | |
| | $I_7$ = 4 mol % | 0.10 μm |
| 6th shell (Arbitrary interposed-shell) | | |
| Arbitrariness | $I_6$ = 2 mol % | 0.27 μm |
| 5th shell (Arbitrary interposed-shell) | | |
| Arbitrariness | $I_5$ = 8 mol % | 0.8 ∞m |
| 4th shell (Highly iodide-containing shell) | | |
| $I_4$–$I_3$ > 3 mol % | $I_4$ = 15 mol % | 1.12μm |
| 3rd shell (Intermediate shell) | | |
| $I_3$–$I_1$ > 3 mol %<br>$I_4$–$I_3$ > 3 mol % | $I_3$ = 8 mol % | 1.24 μm |
| 2nd shell (Intermediate shell) | | |
| $I_2$–$I_1$ > 3 mol %<br>$I_4$–$I_2$ = 3 mol % | $I_2$ = 4 mol % | 1.44 μm |
| 1st shell (Outermost shell) | | |
| $I_1$ = 0 ~ 10 mol % | $I_1$ = 0.5 mol % | 1.6 μm |

4. 8-layer structure interposing respectively the arbitrary 6th and 7th shells between an inner shell and a highly iodide-containing shell, an arbitrary single-layered shell (4th shell) between a highly iodide-containing shell (5th shell) and an intermediate shell (3rd shell), and an arbitrary single-layered shell (2nd shell) between the intermediate shell (3rd shell) and the outermost shell:

| | iodide content | Shell diameter |
|---|---|---|
| 8th shell (Inner core) | | |
| Arbitrariness | $I_8$ = 4 mol % | 0.10 μm |
| 7th shell (Arbitrary shell) | | |
| Arbitrariness | $I_7$ = 2 mol % | 0.27 μm |
| 6th shell (Arbitrary shell) | | |
| Arbitrariness | $I_6$ = 4 mol % | 0.8 μm |
| 5th shell (Highly iodide-containing shell) | | |
| $I_5$–$I_3$ > 3 mol % | $I_5$ = 15 mol % | 1.12 μm |
| 4th shell (Arbitrary shell) | | |
| Arbitrariness | $I_4$ = 9 mol % | 1.24 μm |
| 3rd shell (Intermediate shell) | | |
| $I_3$–$I_1$ > 3 mol % | $I_3$ = 5 mol % | 1.44 μm |
| 2nd shell (Arbitrary shell) | | |
| Arbitrariness | $I_2$ = 4.5 mol % | 1.50 μm |
| 1st shell (Outermost shell) | | |
| $I_1$ = 0 ~ 10 mol % | $I_1$ = 2 mol % | 1.6 μm |

5. Structure having a plurality of highly iodide-containing shells:

| | iodide content | Shell diameter |
|---|---|---|
| 6th shell (Inner core) | | |
| Arbitrariness | $I_6$ = 4 mol % | 0.10 μm |
| 5th shell (Highly iodide-containing shell) | | |
| $I_5$–$I_2$ > 3 mol %<br>$I_5$–$I_1$ > 6 mol % | $I_5$ = 15 mol % | 0.27 μm |
| 4th shell (Arbitrary shell) | | |
| Arbitrariness | $I_4$ = 5 mol % | 0.80 μm |
| 3rd shell (Highly iodide-containing shell) | | |
| $I_3$–$I_2$ > 3 mol %<br>$I_3$–$I_1$ > 6 mol % | $I_3$ = 15 mol % | 1.12 μm |
| 2nd shell (Intermediate shell) | | |
| $I_2$–$I_1$ > 3 mol % | $I_2$ = 5 mol % | 1.44 μm |
| 1st shell (Outermost shell) | | |
| $I_1$ = 0 ~ 10 mol % | $I_1$ = 0.3 mol % | 1.60 μm |

The inner cores of the silver halide grains of the invention can be prepared in such a process as described in, for example, P. Glafkides, 'Chimie et Physique Photographique', published by Paul Montel, 1967; G. F. Duffin, 'Photographic Emulsion Chemistry', published by The Focal Press, 1966; L. Zelikman et al, 'Making and Coating Photographic Emulsion', published by The Focal Press, 1964; and the like. Such processes include any one of an acid process, a neutral process, an ammonia process and the like. Further, a single-jet precipitation process, a double-jet precipitation process of the combination thereof may also be applied to make a reaction of a soluble silver salt on a soluble halide.

Still further, it is also allowed to use the so-called reverse precipitation process in which grains may be formed in presence of silver ions in excess. The so-called controlled double-jet precipitation process, a version of the double-jet precipitation processes, may also be applied for keeping a pAg value of a silver halide produced in a liquid phase. According to this process, a silver halide emulsion regular in crystal form and nearly uniform in grain size may be prepared.

It is also allowed to use a mixture of not less than two kinds of silver halide emulsions each prepared separately, and in this case a double-jet precipitation process or a controlled double-jet precipitation process is preferably used.

A pAg value is varied in accordance with a reaction temperature and the kinds of silver halide solvents when an inner core is prepared, and is preferably from 2 to 11. It is also preferred to use a silver halide solvent, because a grain-forming time may be shortened. Such a silver halide solvent as those of ammonia or thioether which is well-known may be used.

Inner cores may be used in a flat plate, sphere or twinned crystal system and also in the form of an octahedron, cube, tetradecahedron or the mixed forms thereof.

In order to uniform grain sizes, it is preferred to grow up grains rapidly within the critical saturation limit, in such a process as described in, for example, British Patent No. 1,535,016; and Japanese Patent Examined Publication Nos. 36890/1973 and 16364/1977, in which the respective adding rates of silver nitrate and an aqueous solution of a halogenated alkali are adjusted according to the growth rate of grains; or in such a process as described in, for example, U.S. Pat. No. 4,242,445 and Japanese Patent O.P.I. Publication No. 158124/1980, in which the concentration of an aqueous solution is adjusted. The above-mentioned processes are advantageously used also in the case of introducing arbitrary shells, highly iodide-containing shells, intermediate shells or the outermost shells, because any renucleation will not occur and each silver halide grain is uniformly coated in these processes.

In the invention, if occasion demands, a single shell or a plurality of arbitrary shells may be interposed between a highly iodide-containing shell comprising silver halide grains and an intermediate shell. Such highly iodide-containing shells may be provided in such a process as that a desalting step is applied, if necessary, to the resulted inner core or the inner core provided with an arbitrary shell and an ordinary halogen substitution process, a silver halide coating process or the like is then applied.

The halogen substitution process may be applied in the manner, for example, that, after an inner core is formed, an aqueous solution mainly comprising an iodide compound (preferably, potassium iodide), which is preferably not higher than 10% in concentration, is added. This processes are more particularly described in, for example, U.S. Pat. Nos. 2,592,250 and 4,075,020; Japanese Patent O.P.I. Publication No. 127549/1980; and the like. For decreasing an iodide distribution difference between the grains of the highly iodide-containing shell, it is desired, in this process, to adjust the concentration of an aqueous iodide compound solution to $10^{-2}$ mol % or lower and then to add the solution by taking a time for not shorter than ten minutes.

The processes of newly coating a silver halide over to an inner core include, for example, the so-called double-jet precipitation process and controlled double-jet precipitation process each in which an aqueous halide solution and an aqueous silver nitrate solution are simultaneously added. To be more concrete, the processes are described in detail in, for example, Japanese Patent O.P.I. Publication Nos. 22408/1978 and 14829/1983; Japanese Patent Examined Publication No. 13162/1968; 'Journal of Photographic Science', No 24,198, 1976; and the like.

When a highly iodide-containing shell is formed, a pAg value is varied in accordance with a reaction temperature and the kinds and the amount of silver halide solvents used. The same conditions as those for the case of the above-mentioned inner core are preferably applied to this case. When using ammonia to serve as a solvent, a pAg value is desirably from 7 to 11.

Among the processes of forming a highly iodide-containing shell, a double-jet precipitation process and a controlled double-jet precipitation process are preferred more than others.

The intermediate shells of the silver halide grains of the invention may be provided in such a manner that a highly iodide-containing shell is arranged onto the surface of a grain containing the above-mentioned highly iodide-containing shells and the inner cores, or, if required, the highly iodide-containing shell is provided thereon with a single or plurality of arbitrary shells and, to the outside of the above-mentioned grain. A silver halide having a halogen composition different from those of the highly iodide-containing shells is further coated in a double-jet or controlled double-jet precipitation process or the like.

The afore-mentioned highly iodide-containing shell providing process is similarly applied to serve as the above-mentioned processes.

The outermost shell of the silver halide grains of the invention may be provided in such a manner that an intermediate shell is provided to the surface of a grain containing the above-mentioned intermediate shells, the highly iodide-containing shells and the inner shell or, if required, the intermediate shell provided thereon with a single or plurality of arbitrary shells and, to the outside of the above-mentioned grain, a silver halide having a halogen composition different from those of the highly iodide-containing shells is further coated in a double-jet or controlled double-jet precipitation process or the like.

The aforementioned highly iodide-containing shell providing process is similarly applied to serve as the above-mentioned processes.

The arbitrary shells may be interposed singly or plurally, if required, between an inner core and a highly iodide-containing shell, the highly iodide-containing shell and an intermediate shell, and the intermediate shell and the outermost shell, respectively; and it is allowed not necessarily to interpose such an arbitrary shell.

The above-mentioned arbitrary shells may be provided in the same processes as in the case of providing the aforementioned highly iodide-containing shell. When trying to provide a shell adjacent to an inner core, a highly iodide-containing shell, an outermost shell or arbitrary shells provided to the respective positions, an ordinary desalting may also be carried out in the course of providing the adjacent shell, if required, or such shells may be continuously formed without carrying out any desalting.

There may be obtained an iodide content of each coated shell of the silver halide grains of the invention in such a method as described in, for example, J. I. Goldstein and D. B. Williams, 'X-Ray Analyses in TEM/ATEM', Scanning Electron Microscopy, 1977, vol. 1, IIT Research Institute, p. 651, March, 1977; 'Annual Meeting of SPSTJ '84', p 49~51 (1984); 'The International East-West Symposium on the Factors Influencing Photographic Sensitivity (1984)', c-60~c-63 (1984); Japanese Patent O.P.I. Publication No. 143331/1985 and Japanese Patent O.P.I. Publication No. 143332.

In the silver halide grains which are the final products obtained after the outermost shell of the invention was formed, it is allowed, in the preparation of the grains, to remove an excessive halide which was unnecessarily produced or such a salt or compound as a nitrate, ammonia and the like which was by-produced or unnecessarily produced, from the dispersion medium of the grains. The suitable methods of removing the above-mentioned materials include, for example, a nodule washing method usually applied to an ordinary type emulsion; a dialysis method; a sedimentation method utilizing an inorganic salt, an anionic surfactant, such an anionic polymer as a polystyrene sulfonic acid, or such a gelatin derivative as an acylated or carbamoylated gelatin; a flocculation method; and the like.

The core/shell type silver halide grains of the invention can be optically sensitized to a desired wavelength region, and there is no special limitation to the optical sensitization methods. The grains may be optically sensitized by making use, independently or in combination, of such an optical sensitizer as cyanine or merocyanine dyes including, for example, zeromethine, monomethine, dimethine, trimethine and the like. A combination of spectrally sensitizing dyes is often used particularly for a supersensitization. An emulsion is also allowed to contain, as well as the above-mentioned spectrally sensitizing dyes, a dye having no spectrally sensitizing characteristic in itself or a substance substantially incapable of absorbing any visible rays of light but capable of displaying supersensitizing characteristics. These techniques are described in, for example, U.S. Pat. Nos. 2,688,545, 2,912,329, 3,397,060, 3,615,635 and 3,628,964; British Patent Nos. 1,195,320, 1,242,588 and 1,293,862; West German (OLS) Patent Nos. 2,030,326 and 2,121,780; Japanese Patent Examined Publication Nos. 4936/1968 and 14030/1969; Research disclosure, vol. 176, No. 17643, published in Dec., 1978, p. 23, Paragraph IV, Item J; and the like. The above-mentioned techniques may be optionally selected in accordance with a wavelength region, sensitivity and the like to which a sensitization is to be applied and with the purpose and use of a light-sensitive material.

The core/shell type silver halide crystals of the invention may also be treated in various chemical sensitization processes applicable to ordinary type emulsions.

The chemical sensitization may be carried out in such a process as described in, for example, H. Frieser, 'Die Grundlagen der Photographische Prozesse mit Silberhalogeniden', Akademische Verlagsgesselschaft, 1968, pp. 675–734. Namely, there may be used, independently or in combination, a sulfur sensitization process using therein a compound or active gelatin containing sulfur capable of reacting on silver ions; a reduction sensitization process using therein a reducible substance; a noble-metal sensitization process using therein gold and other noble-metal compounds; and the like. As for the sulfur sensitizers, a thiosulfate, a thiourea, a thiazole, a rhodanine and other compounds may be used. They typically include those described in U.S. Pat. Nos. 1,574,944, 2,410,689, 2,278,947, 2,728,668, 3,656,955, 4,032,928 and 4,067,740. As for the reduction sensitizers, a stannous salt, an amine, a hydrazine derivative, a formamidine sulfinic acid, a silane compound and the like may be used. They typically include those described in U.S. Pat. Nos. 2,487,850, 2,419,974, 2,518,698, 2,983,609, 2,983,610, 2,694,637, 3,930,867 and 4,054,458. For the noble-metal sensitization, a gold complex salt and besides the metal complex salts of the VIII group of the periodic table, such as platinum, iridium, palladium and the like may be used. They typically include those described in U.S. Pat. Nos. 2,399,083 and 2,448,060; British Patent No. 618,061; and the like.

The silver salt grains of the invention may be treated in a combination of not less than two of the above-mentioned chemical sensitization processes.

An amount of silver to be coated is not limited but preferably from not less than 1000mg/m$^2$ to not more than 15000mg/m$^2$ and, more preferably, from not less than 2000mg/m$^2$ to not more than 10000mg/m$^2$.

The light-sensitive layers each containing the above-mentioned grains may be present on both sides of a support.

When forming each of the shells of the core/shell type emulsions of the invention, various kinds of dopants may be doped. The inner dopants thereof include, for example, silver, ion, iridium, gold, platinum, osmium, rhodium, tellurium, selenium, cadmium, zinc, lead, thallium, iron, antimony, bismuth, arsenic and the like.

To dope the above-mentioned dopants, the water-soluble salts or complex salts thereof may be made coexist therewith when forming each of the shells.

Next, the magenta couplers represented by the aforegiven Formula [I] (hereinafter called the magenta couplers of the invention) will now be described below:

The substituents represented by R in the aforegiven Formula [I] include, for example, a halogen, an alkyl, cycloalkyl, alkenyl, cycloalkenyl, alkynyl, aryl, heterocyclic, acyl, sulfonyl, sulfinyl, carbamoyl, sulfamoyl, cyano, spiro compound residual, organic hydrocarbon.-compound residual, alkoxy, aryloxy, heterocyclic oxy, siloxy, acyloxy, carbamoyloxy, amino, acylamino, sulfonamido. imido, ureido, sulfamoylamino, alkoxycarbonylamino, aryloxycarbonylamino, alkoxycarbonyl, aryloxycarbonyl, alkylthio, arylthio, heterocyclic or the like group.

The halogen atoms include, for example, chlorine and bromine atoms, and particularly chlorine atom is preferable.

The alkyl groups represented by R include, for example, those each having 1 to 32 carbon atoms; the alkenyl and alkynyl groups include, for example, those each having 2 to 32 carbon atoms; the cycloalkyl and cycloalkenyl groups include, for example, those each having 3 to 12 carbon atoms and, more preferably from 5 to 7 carbon atoms; and the alkyl, alkenyl and alkynyl groups may be of the normal chained or branch chained.

The above-mentioned alkyl, alkenyl, alkynyl, cycloalkyl and cycloalkenyl groups each are allowed to have the following substituents, for example, an aryl or cyano group, a halogen, a heterocyclic, cycloalkyl, cycloalkenyl, spiro compound residual or cross-linked hydrocarbon compound residual group; and besides, those capable of substituting through a carbonyl group, such as an acyl, carboxy, carbamoyl, alkoxycarbonyl or aryloxycarbonyl group; those capable of substituting through a hetero atom (particularly including those capable of substituting through oxygen of a hydroxy, alkoxy, aryloxy, heterocyclic oxy, siloxy, acyloxy, carbamoyloxy or the like group; those capable of substituting through nitrogen of a nitro, amino including a dialkylamino and the like, sulfamoylamino, alkoxycarbonylamino, aryloxycarbonylamino, acylamino, sulfonamido, imido, ureido or the like; those capable of substituting through sulfur of an alkylthio, arylthio, heterocyclicthio, sulfonyl, sulfinyl or sulfamoyl group and the like; those capable of substituting through phosphurus of a sulfonyl group; and the like.)

They typically include, for example, a methyl, ethyl, isopropyl, t-butyl, pentadecyl, heptadecyl, 1-hexylnonyl, 1,1'-dipentylnonyl, 2-chloro-t-butyl, trifluoromethyl, 1-ethoxytridecyl, 1-methoxyisopropyl, methanesulfonylethyl, 2,4-t-amylphenoxymethyl, anilino, 1-phenylisopropyl, 3-m-butanesulfonaminophenoxypropyl, 3,4'-{α-[4''(p-hydroxybenzenesulfonyl)phenoxy]}dodecanoylaminophenylpropyl, 3-{4'[α-2'',4''-di-t-amylphenoxy)butanamido]phenyl}-propyl, 4-[α-(o-chlorophenoxy)tetradecanamidophenoxy]propyl, allyl, cyclopentyl or cyclohexyl group and the like.

The aryl groups preferably include, for example, a phenyl group, and they are allowed to have a substituent such as an alkyl, alkoxy or acylamino group and the like.

They typically include, for example, a phenyl, 4-t-butylphenyl, 2,4-t-amylphenyl, 4-tetradecanamidophenyl, hexadesiloxyphenyl or 4'-[α-(4''-t-butylphenoxy)-tetradecanamido]-phenyl group and the like.

The heterocyclic groups represented by R preferably include, for example, those having 5 to 7 members.

The aryloxycarbonylamino groups represented by R may have a substituent, and they include, for example, a phenoxycarbonylamino, 4-methylphenoxycarbonylamino or like group.

The alkoxycarbonyl groups represented by R include, for example, a methoxycarbonyl, butyloxycarbonyl, dodecyloxycarbonyl, octadecyloxycarbonyl, ethoxymethoxycarbonyloxy, benzyloxycarbonyl or like group, and each may have a further substituent.

The aryloxycarbonyl groups represented by R include, for example, a phenoxycarbonyl, p-chlorophenoxycarbonyl, m-pentadecyloxyphenoxycarbonyl or like group, and they may have a further substituent.

The alkylthio groups represented by R include, for example, an ethylthio, dodecylthio, octadecylthio, phenethylthio, 3-phenoxypropylthio or like group, and they may further have a substituent.

The arylthio groups represented by R include, for example, a phenylthio, p-methoxyphenylthio, 2-t-octylphenylthio, 3-octadecylphenylthio, 2-carboxyphenylthio, p-acetaminophenylthio or like group and, more preferably, a phenylthio group, and they may further have a substituent.

The heterocyclic thio groups represented by R preferably include, for example, a 5 to 7 membered heterocyclic thio group, and they may have a condensed ring.

The nitrogen-containing heterocyclic rings each formed by Z include, for example, a pyrazole, imidazole, triazole or tetrazole ring; and the substituents which the above-mentioned rings each may have include, for example, those described in R.

In the Formula [I] and the Formulas [VI] through [XII] which will be described later, when the substituent (R'' and $R_{11}$ through $R_{17}$, for instance) on a heterocyclic ring has the following formulated part;

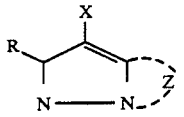

(wherein R, X and Z are synonymous with R, X and Z in the Formula [I]); the so-called bis-type coupler is produced, and it is the matter of course that the couplers of this type shall also be within the scope of the invention. In the rings each formed by Z, and $Z_2$ about which will be described later, it is also allowed that a further ring such as a 5 to 7 membered cycloalkene may be condensed therein. For example, such a ring as a 5 to 7 membered cycloalkene or benzene ring may be formed by coupling $R_{14}$ and $R_{15}$ to each other in Formula [IX] or $R_{16}$ and $R_{17}$ to each other in Formula [X].

The magenta couplers of the invention represented by the Formula [I] are further typically represented by the following Formulas [VI] through [XII]: Formula [VI]

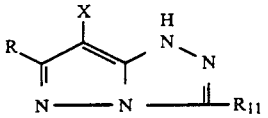

Formula [VI]

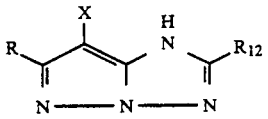

Formula [VII]

-continued

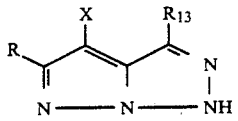

Formula [VIII]

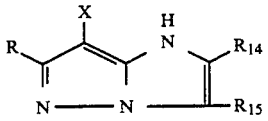

Formula [IX]

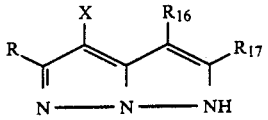

Formula [X]

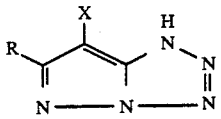

Formula [XI]

In the above Formulas [VI] through [XI], $R_{11}$ through $R_{17}$ and X are synonymous with the aforementioned R and X, respectively, and R, $R_{11}$ through $R_{17}$ or X are allowed to form a polymer not less than a dimer.

Among the magenta couplers of the invention, the preferably useful ones are those represented by the following Formula [XII]:

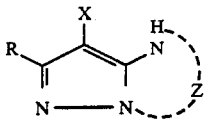

Formula [XII]

wherein R, X and Z are synonymous with R, X and Z denoted in the Formula [I], respectively.

Among the magenta couplers represented by the aforegiven Formulas [VI] through [XII], the particularly preferable ones are those represented by the Formula [VI].

With respect to the substituents on the heterocyclic rings given in the Formulas [I] and [VI] through [XII], they are preferably useful if R in the Formula [I] and in the Formulas [VI] through [XII] may be able to satisfy the following requirement 1; and they are further particularly useful if the above-mentioned R or $R_{11}$ satisfies the following requirements 1 and 2:

Requirement 1: A root atom directly coupled to a heterocyclic ring is to be a carbon atom; and Requirement 2: At least two hydrogen atoms are to be coupled to the above-mentioned carbon atom.

The most preferable substituents R on the above-mentioned heterocyclic ring are represented by the following Formula [XIII].

Formula [XIII]

$R_{20}$—$CH_2$— wherein $R_{20}$ represents hydrogen, a halogen, an alkyl, cycloalkyl, alkenyl, cycloalkenyl, alkynyl, aryl, heterocyclic, acyl, sulfonyl, sulfinyl, phosphonyl, carbamoyl, sulfamoyl, cyano, spiro compound residual, cross-linked hydrocarbon compound residual, alkoxy, aryloxy. carbamoyloxy, amino, acylamino, sulfonamido, imido, ureido, sulfamoylamino, alkoxycarbonylamino, aryloxycarbonylamino, alkoxycarbonyl, aryloxycarbonyl, alkylthio, arylthio or heterocyclic thio group.

The groups each represented by $R_{20}$ are allowed to have a substituent. The typical examples of the groups represented by $R_{20}$ and the substituents which the groups are allowed to have include the typical examples of the groups represented by R in the aforegiven Formula [I] and the substituents thereof.

The preferably useful $R_{20}$ includes, for example, hydrogen or an alkyl group.

The typical examples of the magenta couplers of the invention will be given below, and it is to be understood that the invention shall not be limited thereto. These examples include the following formulas 1-20, 29-82 and 87-143.

1

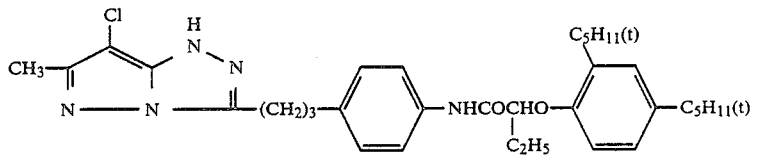

2

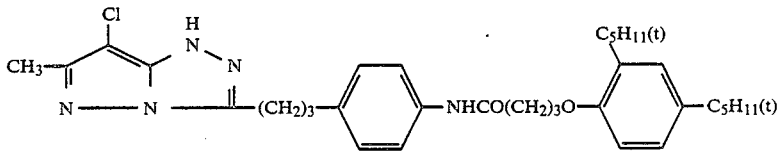

3

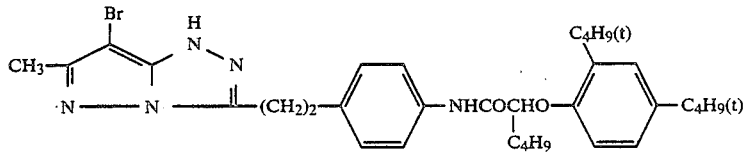

4

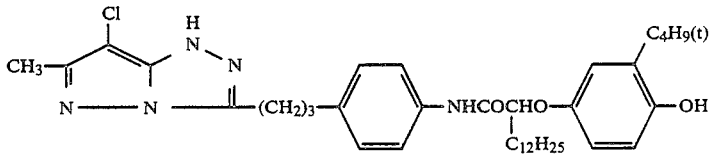

5

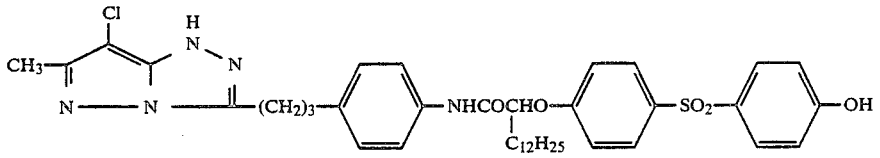

6

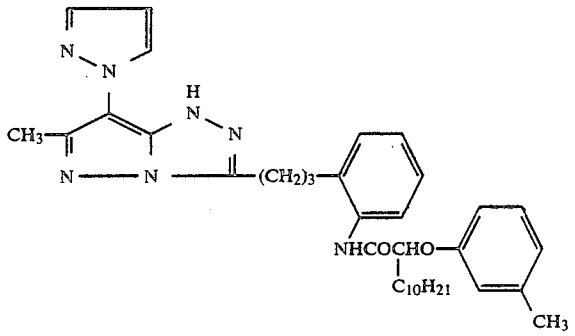

7

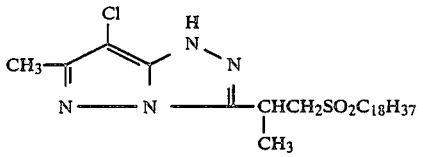

-continued
8
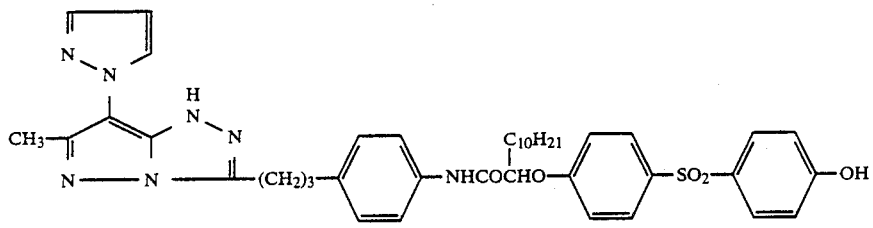
9
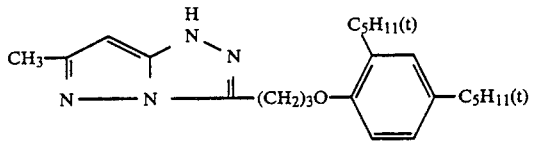
10
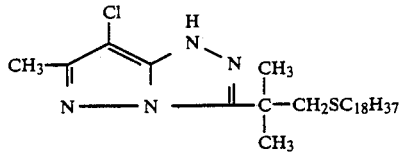
11
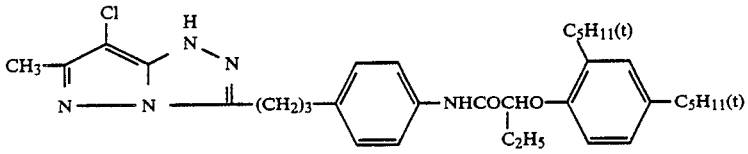
12
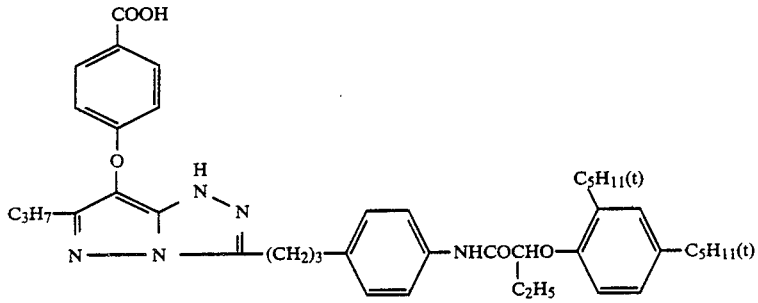
13
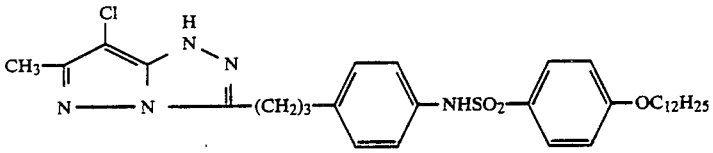
14
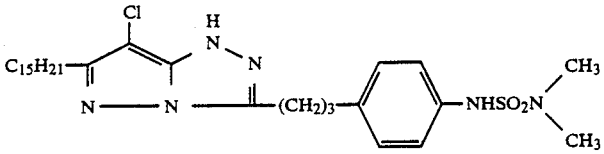
15
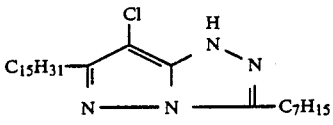

-continued
16
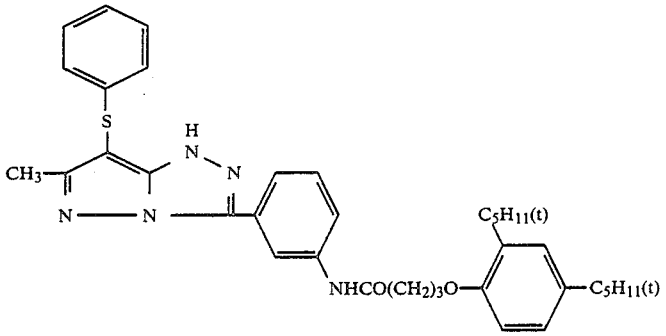
17
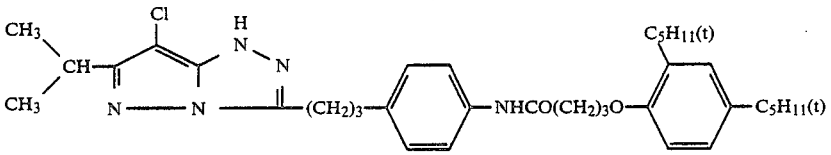
18
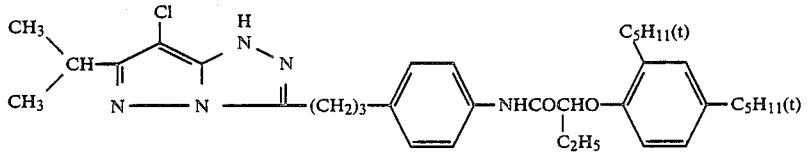
19
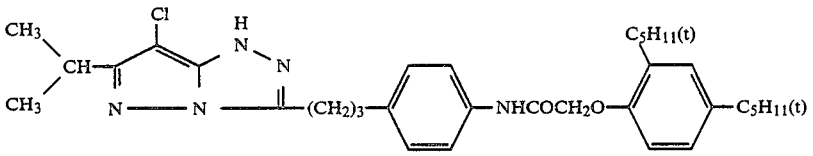
20
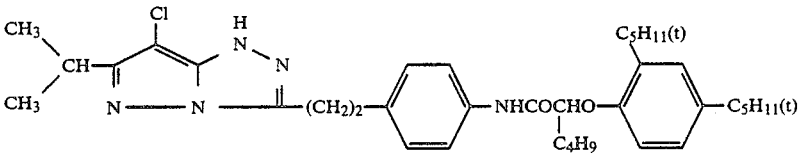
29
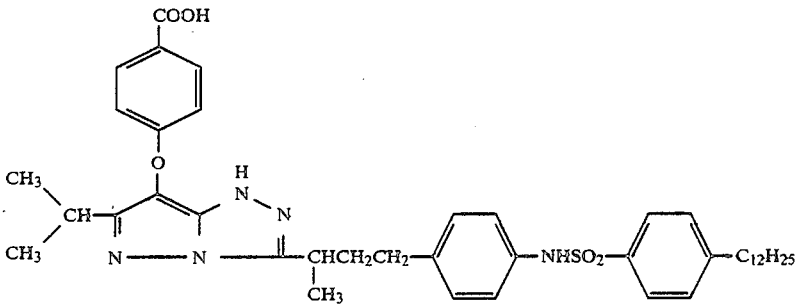
30
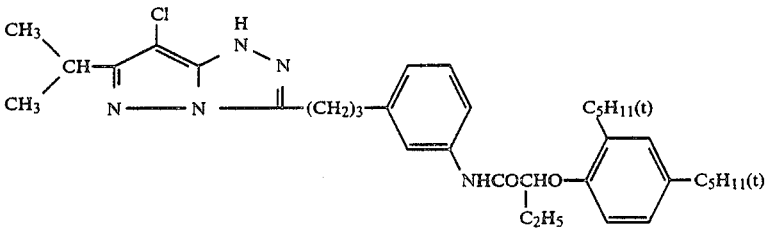

-continued
31
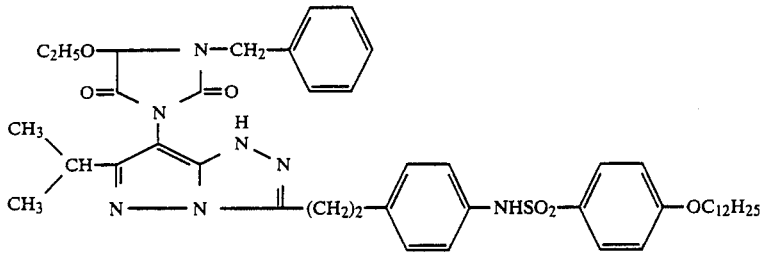
32
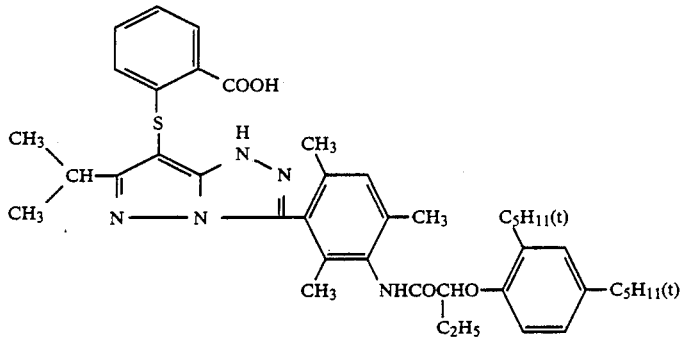
33
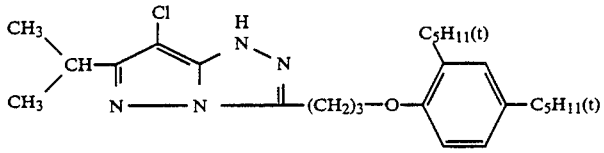
34
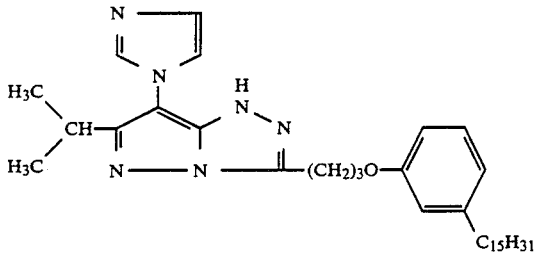
35
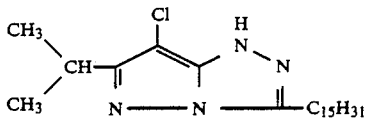
36
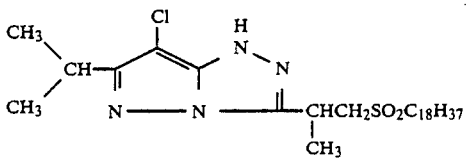
37
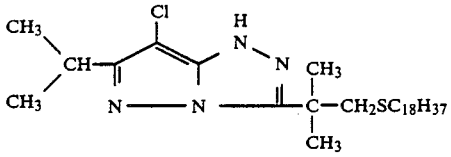

-continued
38
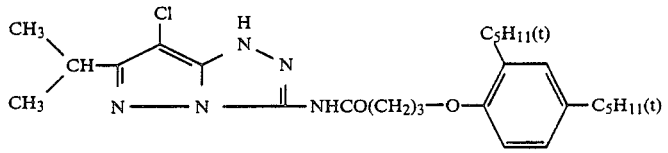
39
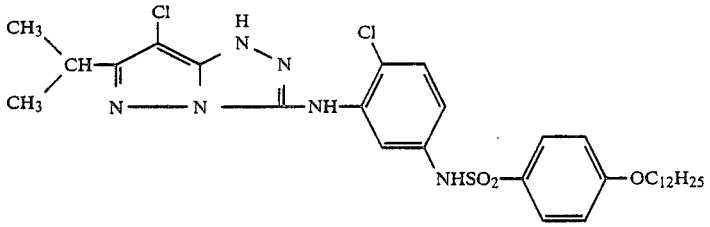
40
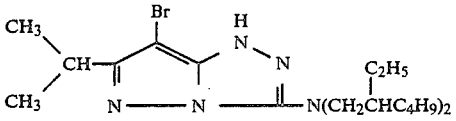
41
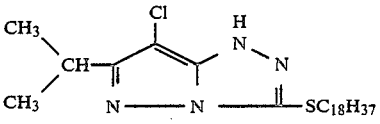
42
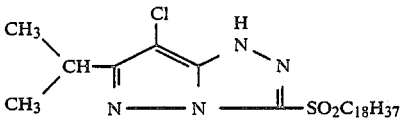
43
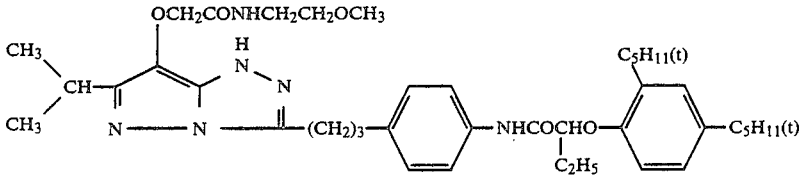
44
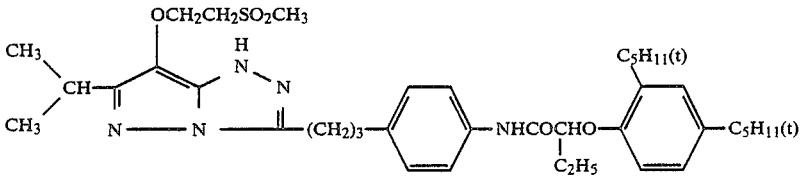
45
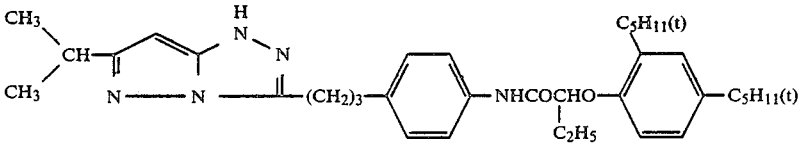
46
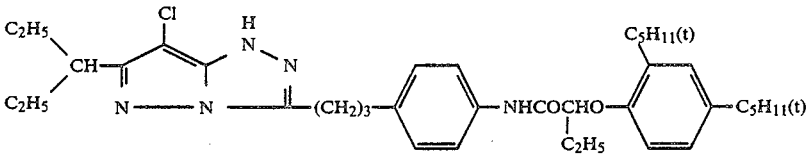

-continued
47
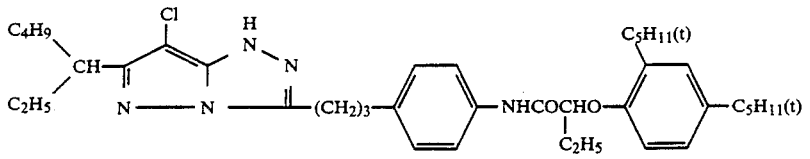
48
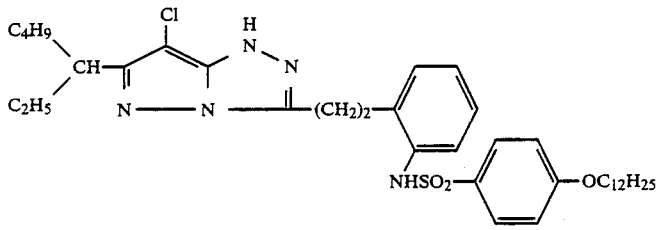
49
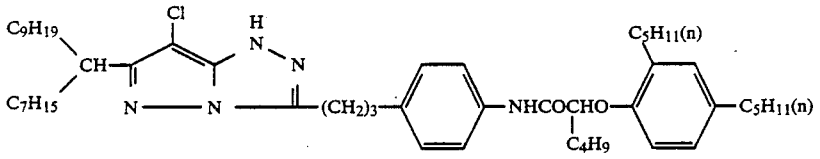
50
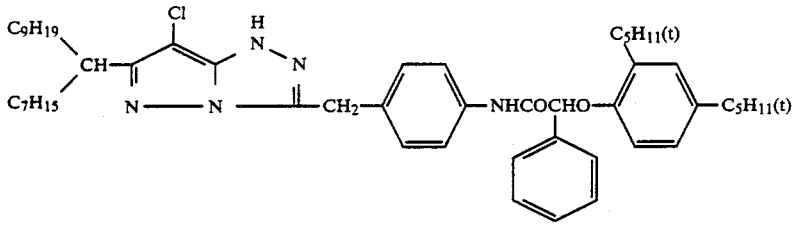
51
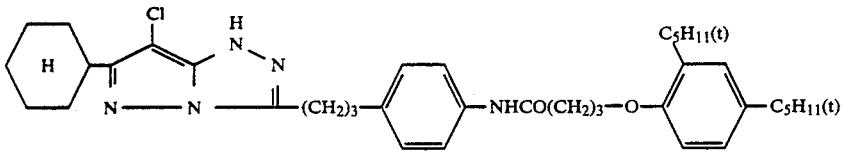
52
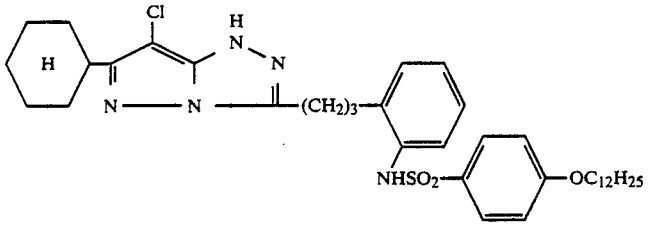
53
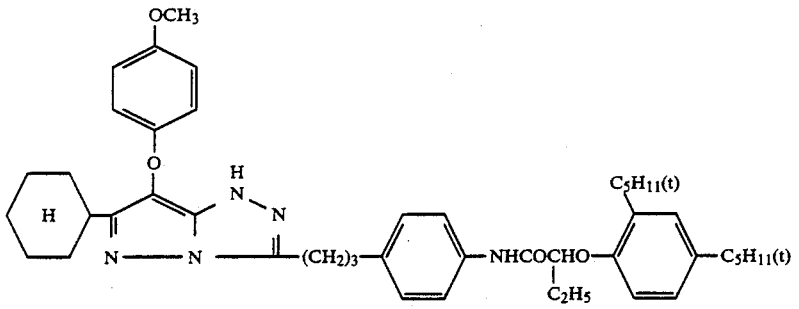

-continued
54
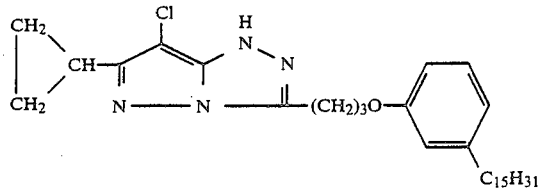
55
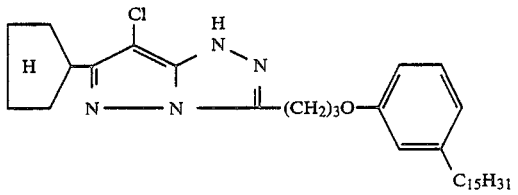
56
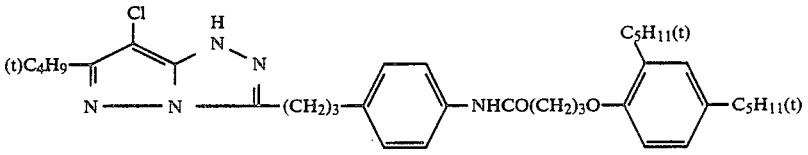
57
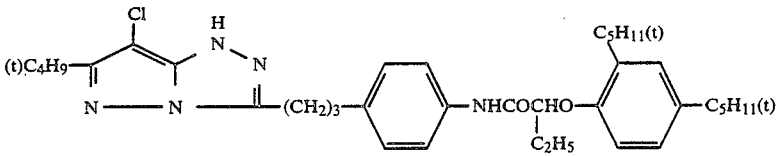
58
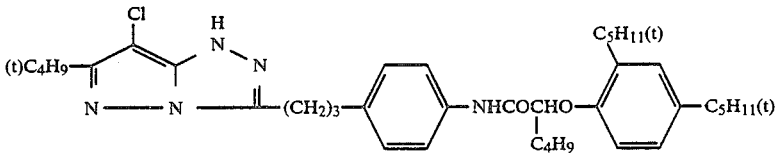
59
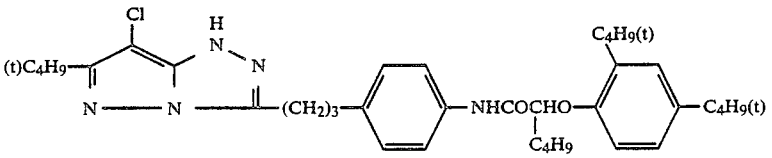
60
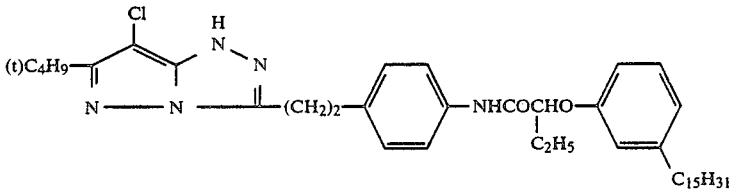
61
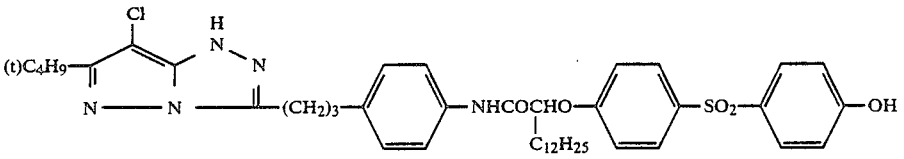
62
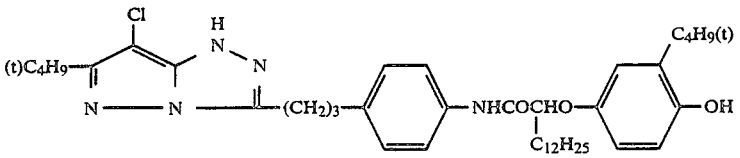

-continued
63
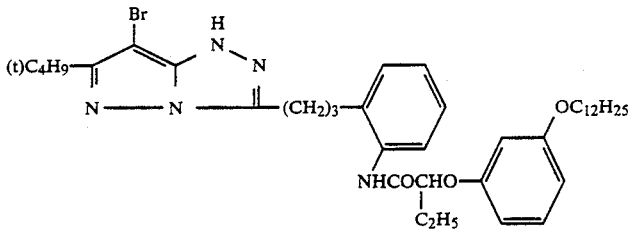
64
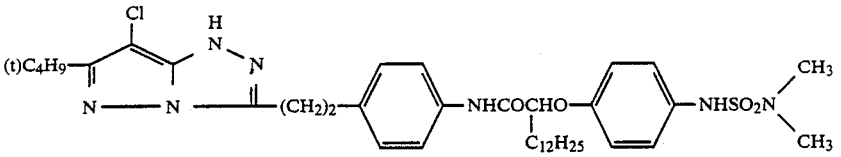
65
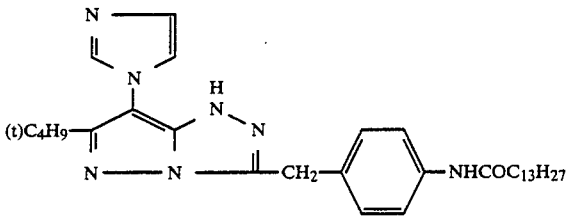
66
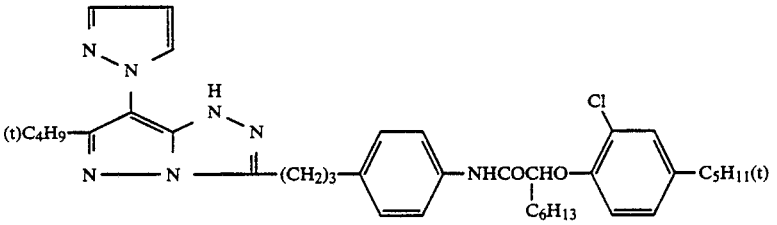
67
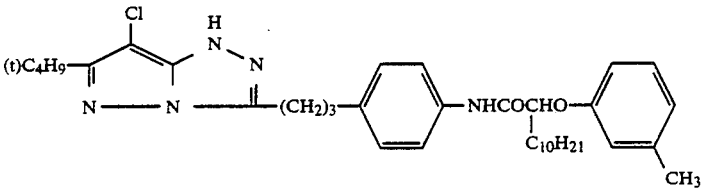
68
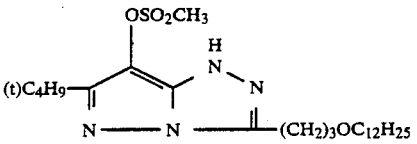
69
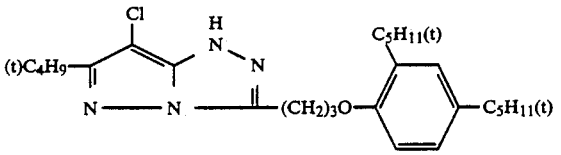

-continued
70
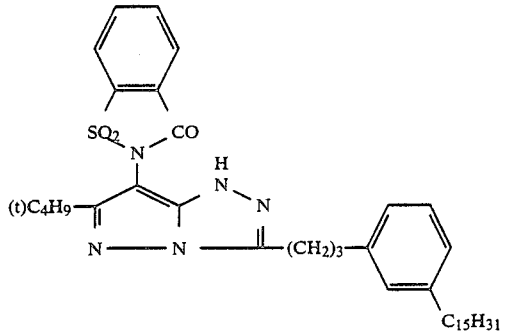
71
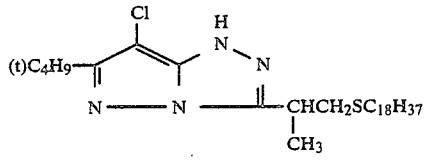
72
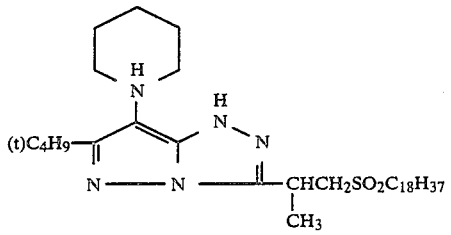
73
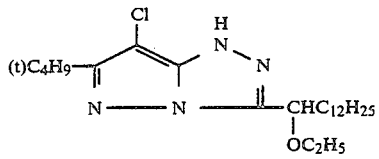
74
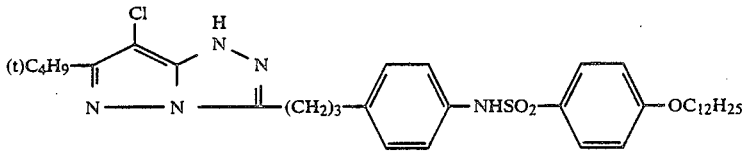
75
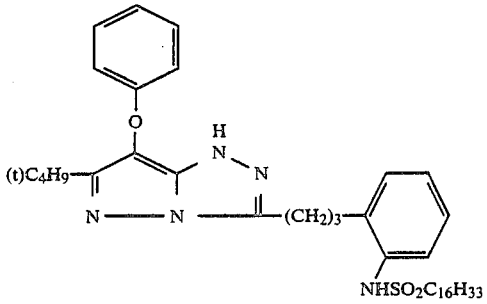
76
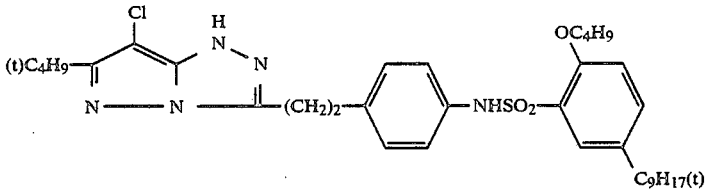

-continued
77.
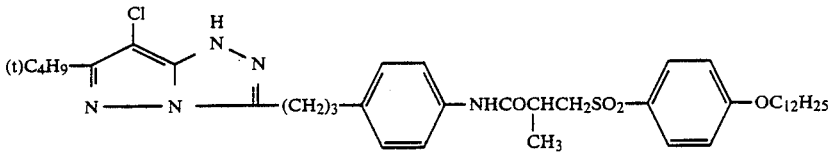
78
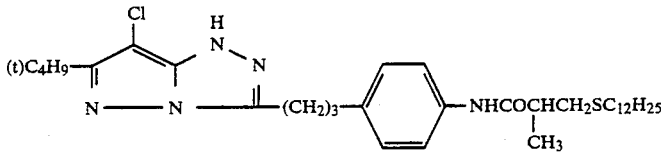
79
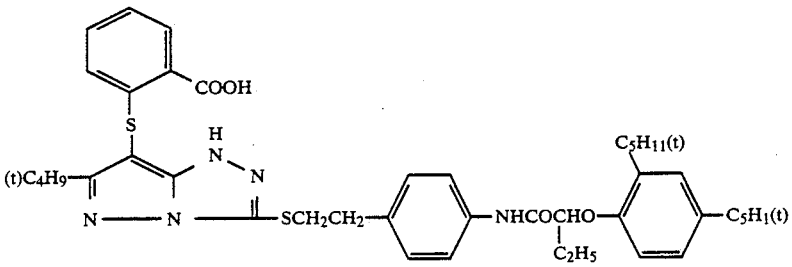
80
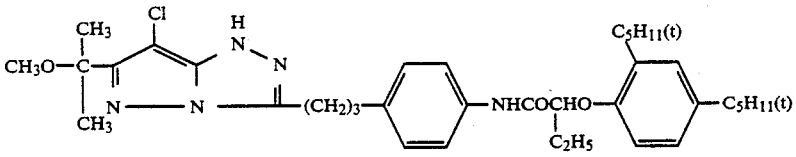
81
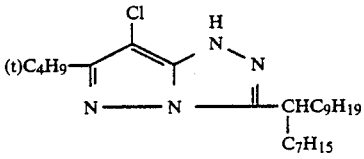
82
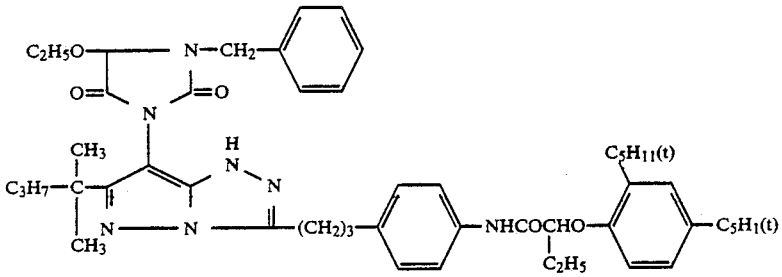
87
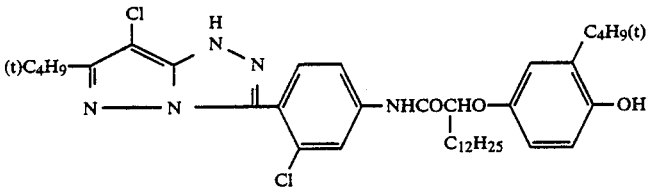

-continued
88
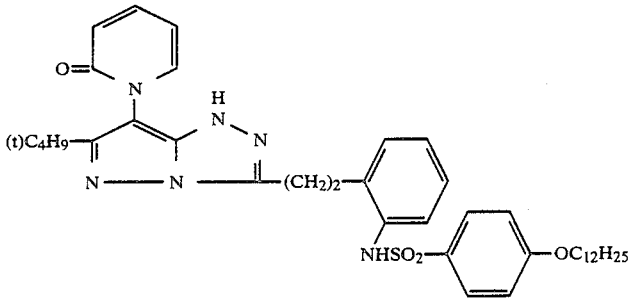
89
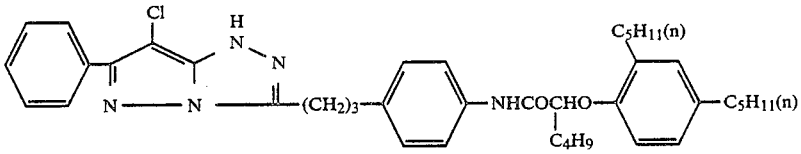
90
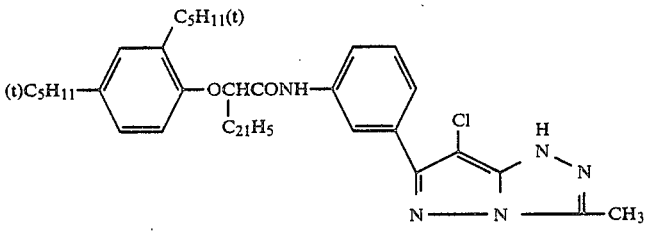
91
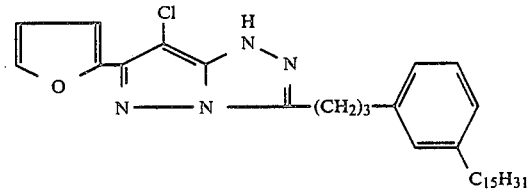
92
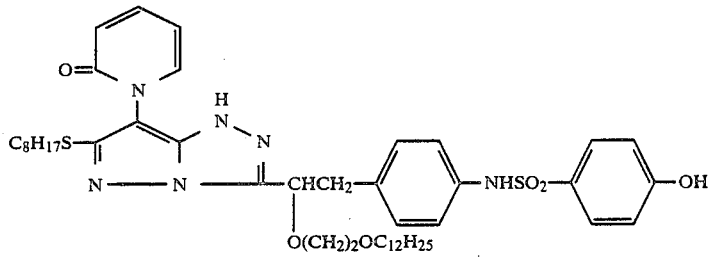
93
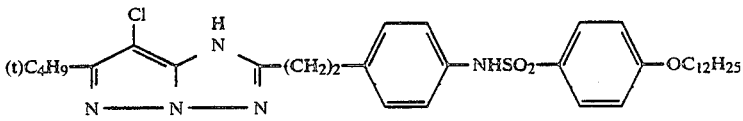
94
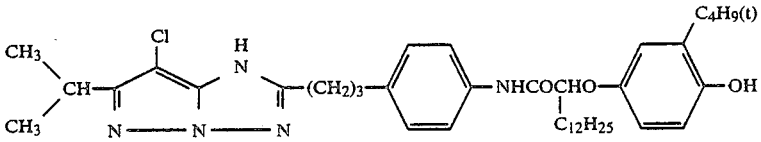
95
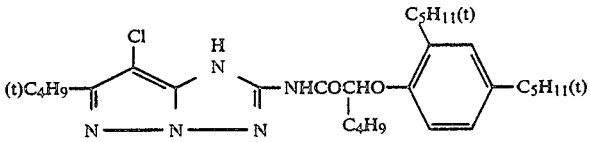

-continued
96
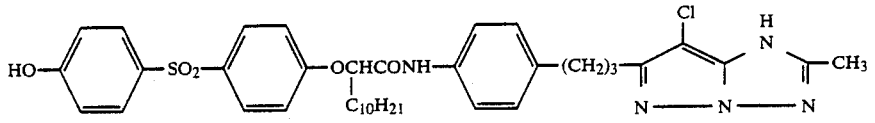
97
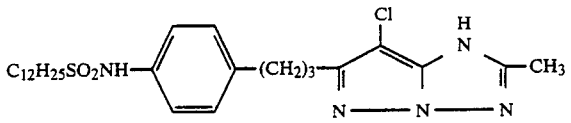
98
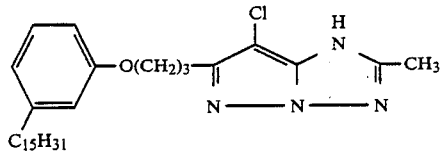
99
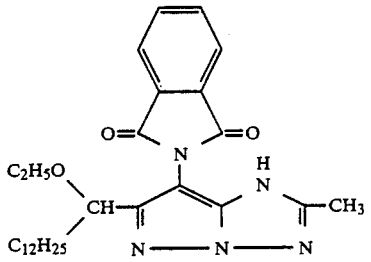
100
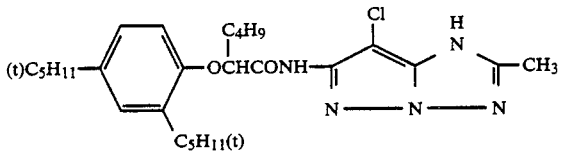
101
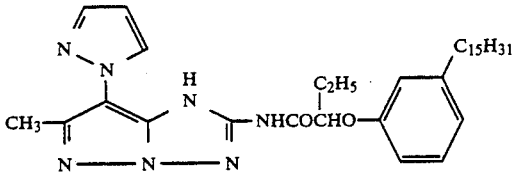
102
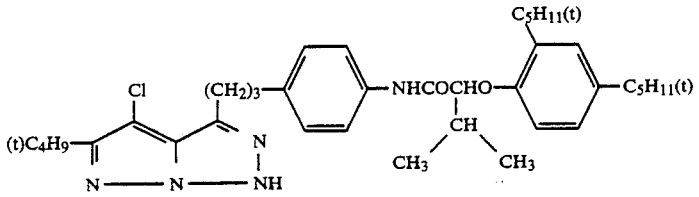
103
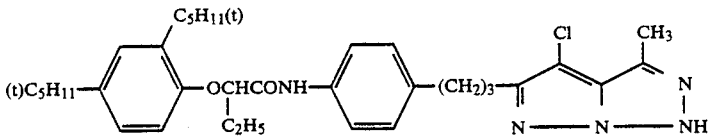
104
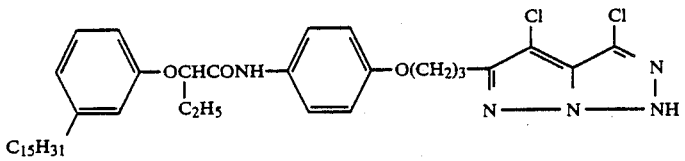

-continued
105
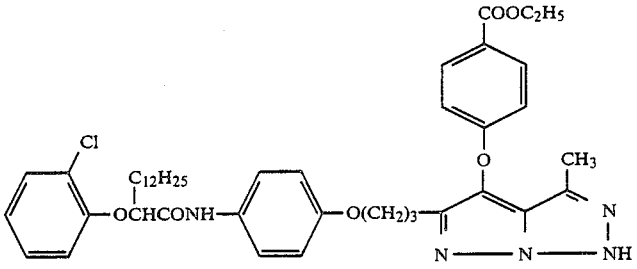
106
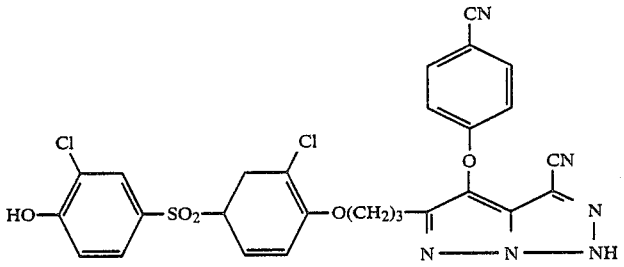
107
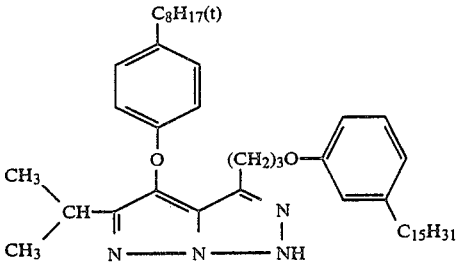
108
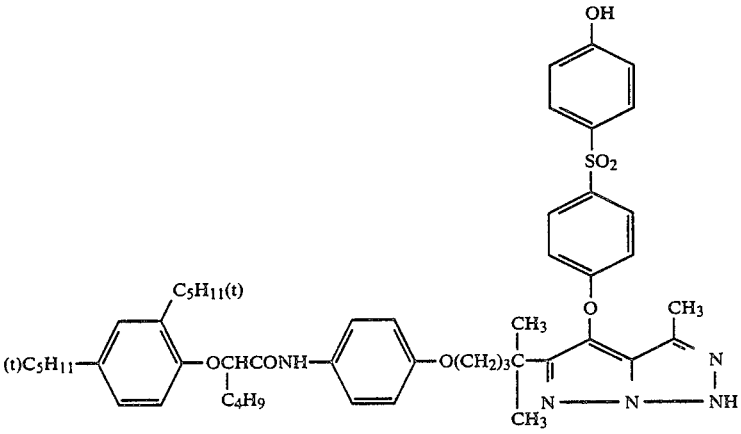
109
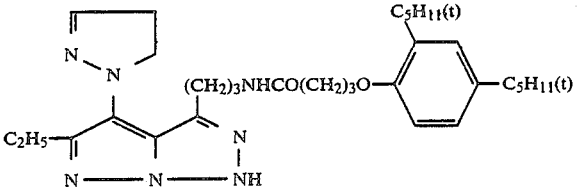
110
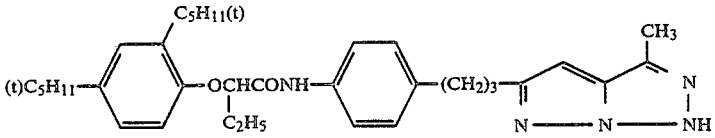

-continued
111
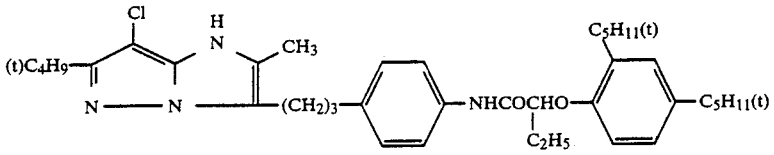
112
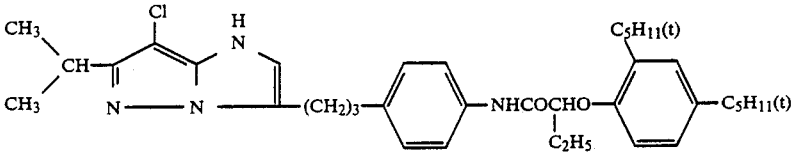
113
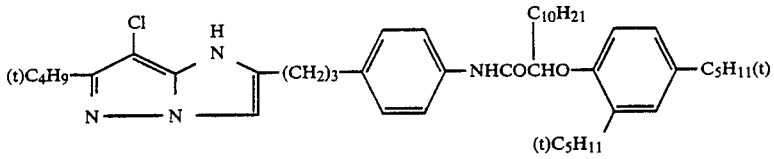
114
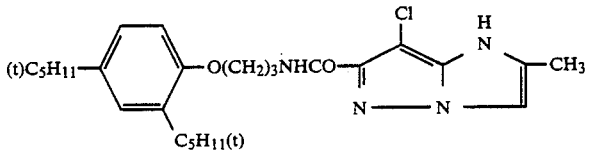
115
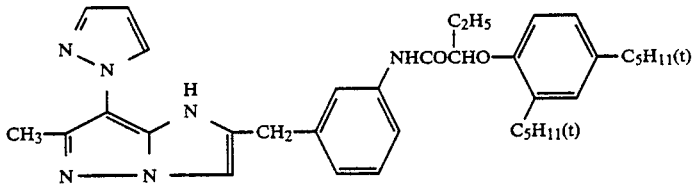
116
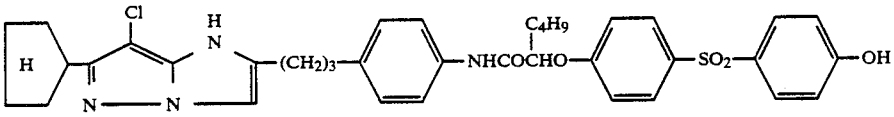
117
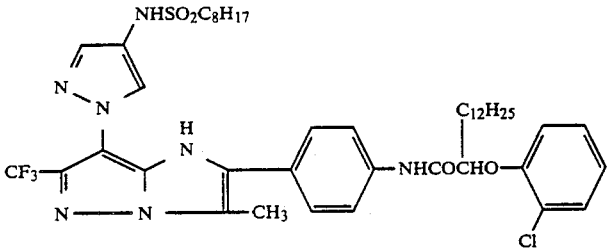
118
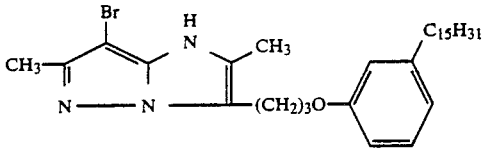
119
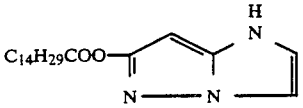
120
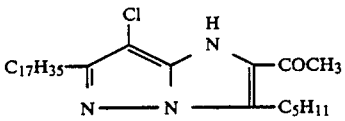

-continued
121
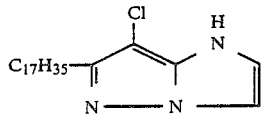
122
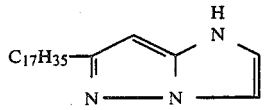
123
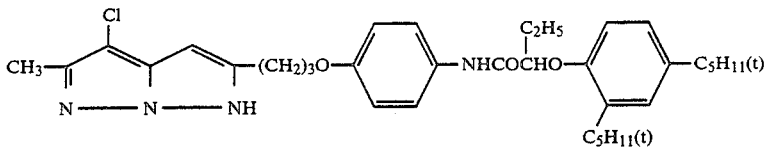
124
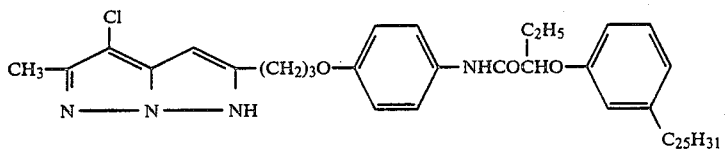
125
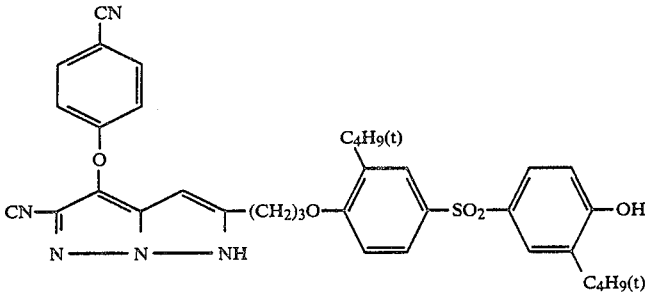
126
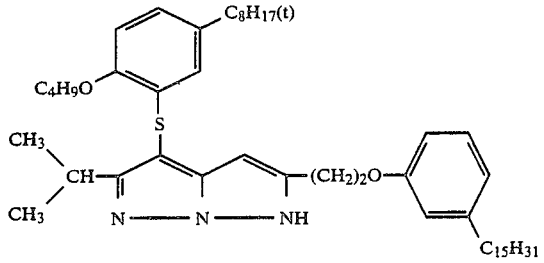
127
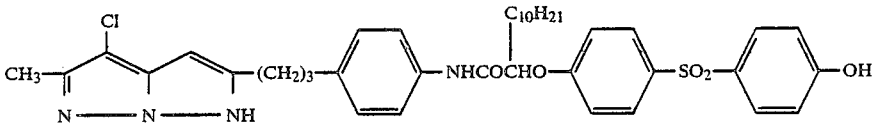
128
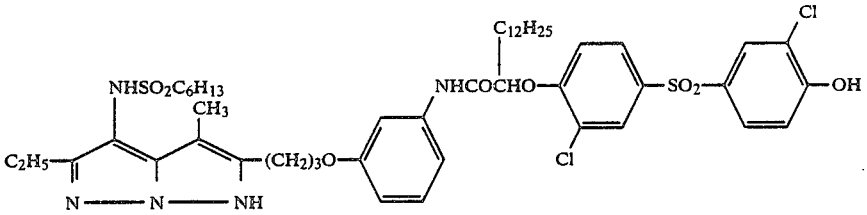

-continued
129
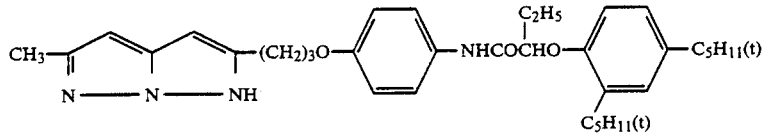
130
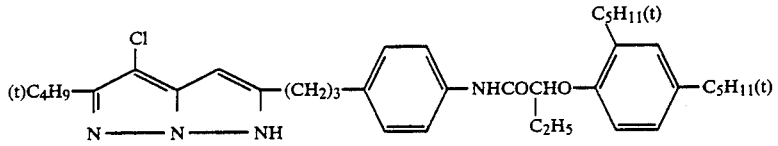
131
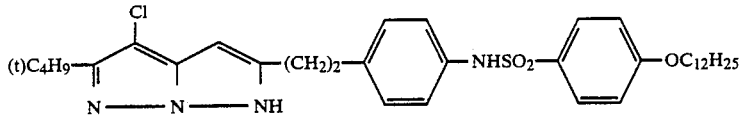
132
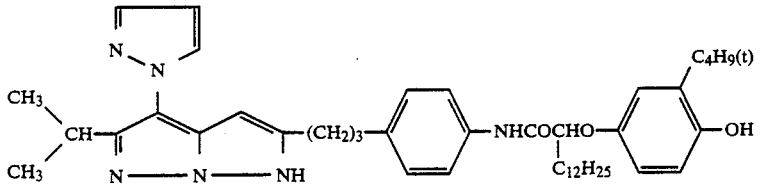
133
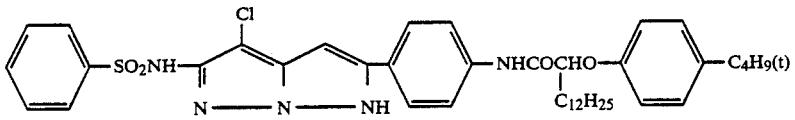
134
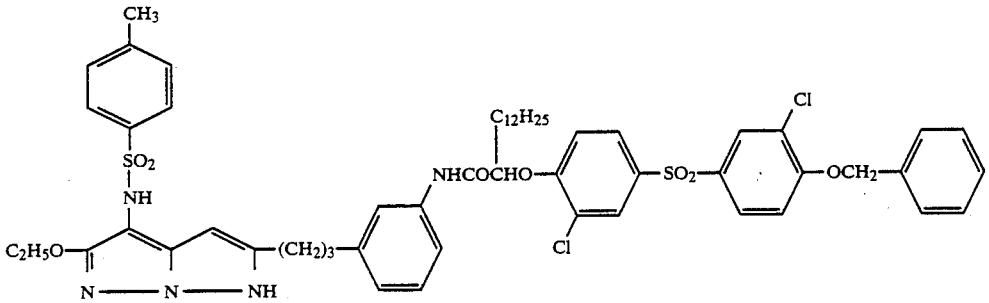
135
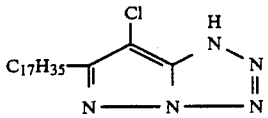
136
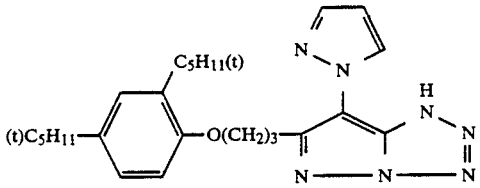
137
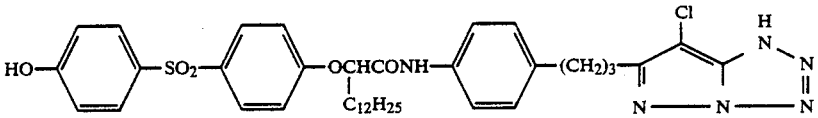

-continued

138

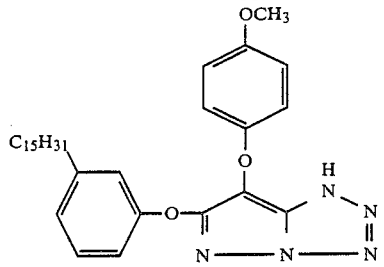

139

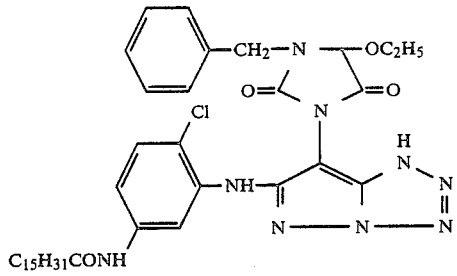

140

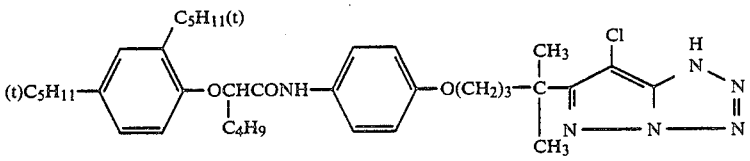

141

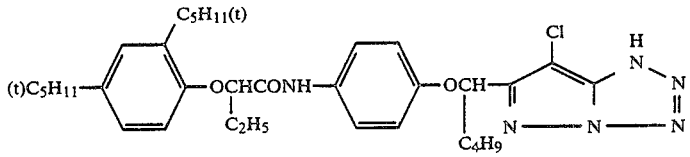

142

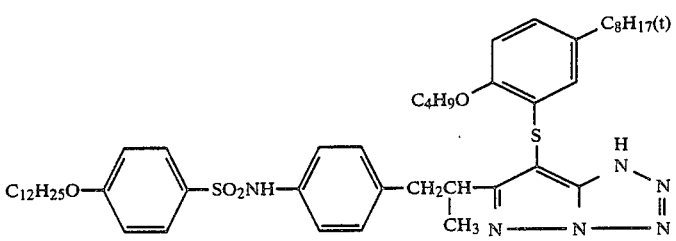

143

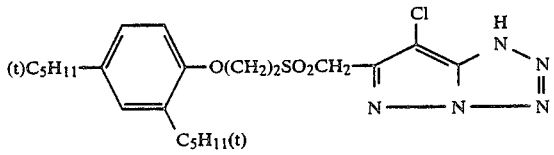

The above-given couplers were synthesized with reference to Journal of the Chemical Society, Perkin I (1977), pp. 2047~2052; U.S. Pat. No. 3,725,067; Japanese Patent O.P.I. Publication Nos. 99437/1984 and 42045/1983; and the like.

The couplers of the invention may be used in an amount within the range of ordinarily from $1\times10^{-3}$ mol to 1 mol and preferably from $1\times10^{-2}$ mol to $8\times10^{-1}$ mol per mol of a silver halide used.

The couplers of the invention may also be used in combination with the other kinds of magenta couplers.

In the case of using the silver halide photographic light-sensitive materials relating to the invention to serve as a multicolor photographic light-sensitive material, the yellow couplers and the cyan couplers which are popularly used in the industry, besides the couplers of the invention, may also be used in a usual manner. If occasion demands, it is also allowed to use a colored couplers capable of effectuating a color compensation. Not less than two kinds of the above-mentioned couplers may also be used in combination in one and the same layer so as to satisfy the characteristics required for a light-sensitive material; and further, the same compound may be added to not less than two layers different from each other.

As for the binders to be used in the core/shell type silver halide grains of the invention, or the dispersion medium to be used in the manufacturing process thereof, a hydrophilic colloid ordinarily used in a silver halide emulsion may also be used. As for the hydrophilic colloids mentioned above, there are not only a gelatin regardless of the lime- or acid-treated but also the following; namely, a gelatin derivative including, for example. those prepared through a reaction of gelatin on either one of an aromatic sulfonyl chloride, acid chloride, acid anhydride, isocyanate or 1,4-diketone, such as described in U.S. Pat. No. 2,614,928; a gelatin derivative prepared through a reaction of gelatin on a trimellitic acid anhydride, such as described in U.S. Pat. No. 3,118,766; a gelatin derivative prepared through a reaction of gelatin on an organic acid having an active halogen, such as described in Japanese Patent Examined Publication No. 5514/1964; a gelatin derivative prepared through a reaction of gelatin on an aromatic glycidyl ether, such as described in Japanese Patent Examined Publication No. 26845/1967; a gelatin derivative prepared through a reaction of gelatin on a maleimide, maleaminic acid or unsaturated aliphatic diamide and the like, such as described in U.S. Pat. No. 3,186,846; a sulfoalkylated gelatin described in British Patent No. 1,033,189; a polyoxyalkylene derivative of a gelatin described in U.S. Pat. No. 3,312,553: a graft gelatin polymer with acrylic acid, methacrilic acid or the esters thereof with a mono- or poly-valent alcohol; a graft gelatin polymer with an amide, acrylonitrile or methacrylonitrile, styrene, or other vinyl monomers used independently or in combination: a synthetic hydrophilic high molecular substance including, for example, a homopolymer comprising such a monomer as vinyl alcohol, N-vinylpyrolidone, hydroxyalkyl (metha)acrylate, (metha)acrylamide, N-substituted (metha)acrylamide or the like, or the copolymers prepared with each other homopolymers mentioned above, a copolymer prepared with either one of the above-mentioned substances and maleic acid anhydride, maleamic acid or the like: a natural hydrophilic high molecular substance other than gelatin including, for example, an independent or a combination of casein, agar and an alginic polysuccharide.

The silver halide photographic emulsions each containing the core/shell type silver halide grains of the invention are allowed to further contain various kinds of additives ordinarily used according to the purposes.

The above-mentioned additives include, for example, a stabilizer and an antifoggant such as an azole or an imidazole, e.g., a benzothiazolium salt, a nitroindazole, a nitrobenzimidazole, a chlorobenzimidazole, a bromobenzimidazole, a mercaptothiazole, a mercaptobenzthiazole, a mercaptobenzimidazole and a mercaptothiadiazole; a triazole, e.g., an aminotriazole, a benzotriazole and a nitrobenzotriazole; a tetrazole, e.g., a mercaptotetrazole, particularly including 1-phenyl-5-mercaptotetrazole and the like; a mercaptopyrimidine; a mercaptotriazine, e.g., a thioketo compound including oxazolinethione; an azaindene, e.g., a triazaindene, a tetraazaindene, particularly including a 4-hydroxy substituted-(1,3,3a,7)tetraazaindene, a pentaazaindene and the like; benzenethiosulfonic acid, benzenesulfinic acid, benzenesulfonic acid amide, an imidazolium salt, a tetrazolium salt, a polyhydroxy compound and the like.

In the photographic light-sensitive materials using therein the core/shell type emulsions of the invention, the photographic emulsion layers and the other hydrophilic colloidal layers thereof are allowed to contain inorganic or organic hardeners, independently or in combination, which include, for example, a chromium salt such as chrome alum, chromium acetate and the like; an aldehyde such as formaldehyde, glyoxal, glutaric aldehyde and the like; a N-methylol compound such as dimethylolurea, methyloldimethylhydantoine and the like; a dioxane derivative such as 2,3-dihydroxydioxane and the like; an active vinyl compound such as 1,3,5-triacryloyl-hexahydro-S-triazine, 1,3-vinylsulfonyl-2-propanol and the like; an active halide such as 2,4-dichloro-6-hydroxy-S-triazine and the like; a mucohalogen acid such as mucochloric acid, mucophenoxychloric acid and the like; and the like.

In the photographic light-sensitive materials using therein the core/shell type emulsions of the invention, the photographic emulsion layers and the other hydrophilic colloidal layers thereof are allowed to contain the dispersed matters of a water-insoluble or hardly soluble synthetic polymer with the purposes of improving the dimensional stability thereof and the like. There may be used the polymers, independently or in combination, including, for example, alkyl (metha)acrylate, alkoxyalkyl (metha)acrylate, glycidyl (metha)acrylate, (metha)acrylamide, a vinyl ester such as vinyl acetate, acrylonitrile, olefin, styrene and the like; or the polymers each having the monomer-components each comprising a combination of the above-mentioned dispersed matters and acrylic acid, methacrylic acid, $\alpha,\beta$-unsaturated dicarboxylic acid, hydroxyalkyl (metha)acrylate, sulfoalkyl (metha)acrylate, styrenesulfonic acid or the like.

The silver halide photographic light-sensitive materials relating to the invention are also allowed to contain, if required, a development accelerator such as benzyl alcohol, a polyoxyethylene compound and the like; an image stabilizer such as those of a chroman, coumaran, bisphenol or phosphorous acid ester; a lubricant such as a wax, glycerides of a higher fatty acid, the higher alcohol esters of a higher fatty acid and the like; a development regulator; a developing agent; a plasticizer; and a bleaching agent. As for the surfactants which are allowed to be contained therein, there may use a coating assistant, a permeability improving agent for a processing liquid or the like, a defoaming agent or various materials of the anion, cation, non-ion or amphoteric type for controlling various physical properties of the light-sensitive materials. As for the antistatic agents, there may effectively use a diacetyl cellulose, a styrene perfluoroalkylsodium maleate copolymer, an alkali salt of the reaction products of a styrene-maleic anhydride copolymer and p-aminobenzenesulfonic acid, and the like. The matting agents include, for example, a polymethacrylic acid methyl, a polystyrene, an alkali-soluble polymer and the like. In addition, a colloidal silica oxide may also be used. The latexes to be added for improving the physical properties of layers include, for example, a copolymer of an acrylic ester, a vinyl ester or the like and a monomer having the other ethylene group. The gelatin plasticizers include, for example, glycerol and a glycol compound. The thickening agents include, for example, a styrene-sodium maleate copolymer, an alkylvinylether-maleic acid copolymer and the like.

The emulsions each having the silver halide grains of the invention may be provided with a wide latitude, if they are prepared by mixing at least two emulsions which are different from each other in average grain size and sensitivity.

When applying a core/shell type silver halide emulsion relating to the invention to a color photographic light-sensitive material, the silver halide emulsion is to be treated in such a process as usually applied to a color light-sensitive material as well as with the materials therefor. In the above-mentioned process, cyan, magenta and yellow couplers are contained in the emulsions each having the aforementioned crystals and having been adjusted to be red-, green- and blue-sensitive, respectively. The above-mentioned materials include, for example, the magenta couplers such as that of 5-pyrazolone, pyrazolobenzimidazole, cyanoacetylcoumaran, open-chained acylacetonitrile or the like; the yellow couplers such as that of acylacetoamide (e.g., a benzoylacetanilide and a pivaloylacetanilide) or the like; and the cyan couplers such as that of naphthol, phenol or the like. The above-mentioned couplers are desired to be the non-diffusible ones each having, in the molecules thereof, a hydrophobic group that is so-called ballast group. The couplers may be of either 4- or 2-equivalent per silver ion. They may also be colored couplers capable of displaying a color-compensation effect or couplers capable of releasing a development inhibitor while a development is being carried out, (which are called 'DIR couplers'). The above-mentioned emulsions are also allowed to contain, besides the DIR couplers, a non-coloration DIR coupling compound which is capable of producing a colorless coupling reaction products and also releasing a development inhibitor.

When embodying the invention, the undermentioned well-known anti-discoloring agent may jointly be used, and color image stabilizers used for the invention may also be used independently or in combinaton. Such anti-discoloring agents include, for example, a hydroquinone derivative, a gallic acid derivative, a p-alkoxyphenol, a p-oxyphenol derivative, a bisphenol and the like.

In the light-sensitive materials of the invention, the hydrophilic layers thereof may contain such a UV absorbing agent as a benzotriazole compound substituted by an aryl group, a 4-thiazolidone compound, a benzophenone compound, a cinnamic acid ester compound, a butadiene compound, a benzoxazole compound, a UV absorptive polymer, and the like. It is also allowed that such UV absorbing agents may be fixed into the above-mentioned hydrophilic colloidal layers.

In the light-sensitive materials of the invention, the hydrophilic layers thereof are allowed to contain a water-soluble dyestuff to serve as a filter dyestuff or with the various purposes of preventing an irradiation and the like.

Such dyes as mentioned above include, for example, an oxonol, hemioxonol, styryl, merocyanine, cyanine or azo dye. Among them, the hemioxonol dyes and the merocyanine dyes are particularly useful.

The light-sensitive materials of the invention are allowed to contain such anticolor-fogging agent as a hydroquione derivative, an aminophenol derivative, a gallic acid derivative, an ascorbic acid derivative and the like.

This invention may also be applied to a multilayered multicolor photographic light-sensitive material comprising a support bearing thereon at least two light-sensitive layers having different spectral sensitivity from each other. Generally, a multilayered color photographic material is provided, on the support thereof, with at least one each of red-, green- and blue-sensitive emulsion layers, respectively. The layer arrangement order may be freely selected according to the necessity. It is a usual combination to contain cyan forming couplers in a red-sensitive emulsion layer, magenta forming couplers in a green-sensitive emulsion layer and yellow forming couplers in a blue-sensitive emulsion layer, however, a different combination may also be adopted, if occasion demands.

In the photographic light-sensitive materials of the invention, the photographic emulsion layers and other hydrophilic colloidal layers thereof may be coated on the support or other layers thereof in various well-known coating methods such as a dip-coating method, a roller-coating method, a curtain-coating method, an extrusion-coating method and the like. The advantageous methods thereof are described in, for example, U.S. Pat. Nos. 2,681,294, 2,761,791 and 3,526,528.

The supports of the above-mentioned photographic light-sensitive materials include, for example, a baryta paper, a polyethylene-coated paper, a synthetic polypropylene paper, a glass plate, a cellulose acetate film, a cellulose nitrate film, a polyvinyl acetal film, a polypropylene film, a polyester film such as a polyethyleneterephthalate film, a polystyrene film, and the like, each of which is ordinarily used and may suitably be selected according to the purposes of using the photographic light-sensitive materials.

The above-mentioned supports may also be sublayered, if occasion demands.

The photographic light-sensitive materials containing the core/shell type silver halide emulsions relating to the invention may be exposed to light and, after then, developed in any well-known process being normally used.

A black-and-white developer is an alkaline solution containing such a developing agent as a hydroxybenzene, an aminophenol, an aminobenzene or the like and, beside the above, it is also allowed to contain a sulfite, carbonate, bisulfite, bromide or iodide each produced with an alkali metal salt. When the above-mentioned photographic light-sensitive material is for color photographic use, it may be color developed in any color developing process being normally used. In a reversal process, a development is made with a black-and-white developer at first, and a white-light exposure is applied or a treatment is made in a bath containing a fogging agent, and further a color-development is made with an alkaline developer containing a color developing agent. There is no particular limitation to the processes, but any processes may be applied. A typical example of such processes is that, after color-developing, a bleach-fixing is made and, if required, a washing and a stabilizing are then made; and the other example thereof is that, after color-developing, a bleaching and a fixing are separately made and, if required, a washing and a stabilizing are further made. Generally, a color developer comprises an aqueous alkaline solution containing a color developing agent. The color developing agents include, for example, such a well-known aromatic primary amine developer as a phenylenediamine, e.g., 4-amino-N,N-diethylaniline, 3-methyl-4-amino-N,N-diethyl aniline, 4-amino-N-ethyl-N-$\beta$-hydroxyethylaniline, 3-methyl-4-amino-N-ethyl-N-$\beta$-hydroxyethylaniline, 3-methyl4-amino-N-ethyl-N-$\beta$-methanesulfonamidoerhylaniline. 4-amino-3-methyl-N-ethyl-N-$\beta$-methoxyethylaniline, and the like.

Besides the above, there may be able to use those described in, for example, L. F. A. Mason, 'Photographic Processing Chemistry', Focal Press, 1966, pp. 226–229; U.S. Pat. Nos. 2,193,015 and 2,592,364; Japanese Patent O.P.I. Publication No. 64933/1973; and the like.

The color developers are also allowed to contain a pH buffer, an antifoggant and the like, besides the above. They may further contain, if required, a water softener, a preserver, an organic solvent, a development accelerator, a dye forming coupler, a competing coupler, a fogging agent, an auxiliary developer, a thickener, a polycarboxylic acid chelating agent, an oxidation inhibitor and the like.

The photographic emulsion layers are ordinarily bleached after they were color-developed. Such bleaching process may be carried out either simultaneously with or separately from a fixing process. The bleaching agents for this purpose include, for example. the compounds of such a polyvalent metal as iron (III), cobalt (IV), chromium (VI), copper (II) and the like; a peroxy acid, a quinone, a nitroso compound, and the like.

It is allowed to add to a bleaching or bleach-fixing liquid with various additives as well as the bleaching accelerators such as those described in, for example, U.S. Pat. Nos. 3,042,520 and 3,241,966, Japanese Patent Examined Publication Nos. 8506/1967 and 8836/1967, and the like; the thiol compounds such as those described in, for example, Japanese Patent O.P.I. Publication No. 65732/1978.

EXAMPLE

The following examples will further illustrate preferred preparation and the property of the silver halide grains and the silver halide photographic light-sensitive material relating to the invention. Preparation of silver halide grains

PREPARATION EXAMPLE 1

(1-1) Preparation of Inner Core

By making use of the following six kinds of solutions, a silver iodide emulsion EM-1 was prepared so as to contain silver iodide in an amount of 4 mol % thereof

| | |
|---|---|
| (Solution A-1) | |
| Ossein gelatin | 39.7 g |
| Distilled water | 3,936 ml |
| A 10% ethanol solution of sodium polyisopropylene-polyethyleneoxy--disuccinate | 35.4 ml |
| Magnesium sulfate | 3.6 g |
| A 6% solution of nitric acid | 75.6 ml |
| Potassium bromide | 2.06 g |
| (Solution B-1) | |
| Ossein gelatin | 35.4 g |
| Potassium bromide | 807 g |
| Potassium iodide | 47 g |
| A 10% ethanol solution of sodium polyisopropylene-polyethyleneoxy--disuccinate | 35.4 ml |
| Distilled water | 1,432 ml |
| (Solution E-1) | |
| Silver nitrate | 1200 g |
| A 6% solution of nitric acid | 62 ml |
| Distilled water | 1,467 ml |
| (Solution F-1) | |
| A 25% aqueous solution of KBr | An amount required for pAg value adjustment. |
| (Solution H-1) | |
| A 6% solution of nitric acid | An amount required for pH value adjustment. |
| (Solution I-1) | |
| A 7% aqueous solution of sodium carbonate | An amount required for pH value adjustment. |

Both Solutions of E-1 and B-1 were added to Solution A-1 in a double-jet precipitation method, at 40° C., by making use of a mixing stirrer described in Japanese Patent O.P.I. Publication Nos. 92523/1982 and 92524/1982. While the double-jet precipitation method was being applied, the pAg and pH value thereof and the adding rates of both Solutions of E-1 and B-1 were controlled as shown in Table I. The pAg and pH values were controlled by adjusting the flow rates of both Solutions F-1 and H-1 by making use of a roller-tube pump capable of changing flow rates.

Three minutes after the addition of Solution E-1 was completed, a pH value of the resulted matter was adjusted with Solution I-1.

Next, the resulted matter was desalted and washed in an ordinary method and dispersed in an aqueous solution containing 125 g of ossein gelatin. After then, an aggregate amount of the dispersed matter was adjusted with distilled water to 4,800 ml.

It was observed with an electron microscope that the resulted emulsion was a monodispersed emulsion of 0.09μm in average grain size. Hereinafter, the term, 'grain size', means a length of one side of a cube which is equivalent to a grain in volume.

TABLE 1

| Time (min) | Rate of adding solution (ml/min) Solution E-1 | Solution B-1 | pAg | pH |
|---|---|---|---|---|
| 0.00 | 15.9 | 15.9 | 9.0 | 2.0 |
| 1.50 | 15.9 | 15.9 | 9.0 | 2.0 |
| 2.00 | 15.9 | 15.2 | 9.0 | 2.0 |
| 5.00 | 15.9 | 15.2 | 9.0 | 2.0 |
| 10.30 | 29.1 | 28.4 | 9.0 | 2.0 |
| 13.72 | 39.8 | 39.1 | 9.0 | 2.0 |
| 16.37 | 49.2 | 48.5 | 9.0 | 2.0 |
| 17.95 | 55.0 | 54.3 | 9.0 | 2.0 |
| 18.65 | 57.8 | 57.1 | 9.0 | 2.0 |
| 20.55 | 65.7 | 65.0 | 9.0 | 2.0 |
| 22.25 | 73.2 | 72.5 | 9.0 | 2.0 |
| 25.20 | 87.2 | 86.3 | 9.0 | 2.0 |
| 26.50 | 93.8 | 92.9 | 9.0 | 2.0 |
| 27.70 | 100.2 | 99.9 | 9.0 | 2.0 |
| 28.85 | 106.3 | 105.3 | 9.0 | 2.0 |
| 29.95 | 112.3 | 111.1 | 9.0 | 2.0 |
| 30.95 | 118.1 | 117.0 | 9.0 | 2.0 |
| 31.92 | 123.8 | 122.6 | 9.0 | 2.0 |
| 32.10 | 124.8 | 123.5 | 9.0 | 2.0 |

(1-2) Provision of the 5th Shell

Emulsion EM-2 was prepared, by using the following 5 kinds of solution, in such a process that the above-mentioned Emulsion EM-1 was used as a seed emulsion to which silver iodobromide shells each having a silver iodide content of 2 mol % were provided.

| | |
|---|---|
| (Solution A-2) | |
| Ossein gelatin | 34.54 g |
| Distilled water | 8,642 ml |
| A 10% ethanol solution of sodium polyisopropylene-polyethyleneoxy-disuccinate | 20 ml |
| 4-hydroxy-6-methyl-1,3,3a,7--tetrazaindene | 181.32 mg |
| A 28% aqueous ammonia | 117.4 ml |
| A 56% aqueous solution of acetic acid | 154 ml |
| Magnesium sulfate | 16 g |
| Seed emulsion (EM-1) | An equivalent amount to 0.329 mol |
| (Solution B-2) | |
| Ossein gelatin | 18.72 g |
| KBr | 763.8 g |
| KI | 21.8 g |
| 4-hydroxy-6-methyl-1,3,3a,7- | 2.17 g |

-continued

| | |
|---|---|
| tetrazaindene | |
| Magnesium sulfate | 7.4 g |
| Distilled water | 1,578 ml |
| (Solution E-2) | |
| $AgNO_3$ | 1,142.4 g |
| A 28% aqueous ammonia | 931.4 ml |
| Add distilled water to make | 1,921 ml |
| (Solution F-2) | |
| A 50% aqueous solution of KBr | An amount required for pAg value adjustment. |
| (Solution G-2) | |
| A 56% aqueous solution of acetic acid | An amount required for pH value adjustment. |

Both Solutions of E-2 and B-2 were added to Solution A-2 in a double-jet precipitation method, at 40° C., by making use of a mixing stirrer described in Japanese Patent O.P.I. Publication Nos. 92523/1982 and 92524/1982, by taking a time for 32.5 minutes at a minimum so as not to produce any small grains during the addition thereof. While the double-jet precipitation method was being applied, the pAg and pH value thereof and the adding rates of both Solutions of E-2 and B-2 were controlled as shown in Table 2. The pAg and pH values were controlled by adjusting the flow rates of Solutions F-2, F-2 and B-2 by making use of a roller-tube pump capable of changing flow rates.

After the addition of Solution E-2 was completed, the pAg value was adjusted to 10.4 with Solution G-2 and, two minutes after then, the pH value was adjusted to 6.0 with Solution G-2, respectively.

TABLE 2

| Time (min) | Rate of adding solution (ml/min) Solution E-2 | Solution B-2 | pAg | pH |
|---|---|---|---|---|
| 0.00 | 16.24 | 15.44 | 8.50 | 8.00 |
| 5.43 | 41.87 | 40.15 | 8.54 | 7.95 |
| 8.17 | 60.36 | 58.69 | 8.58 | 7.88 |
| 10.88 | 76.58 | 74.98 | 8.64 | 7.78 |
| 13.62 | 83.78 | 82.24 | 8.71 | 7.66 |
| 16.33 | 81.82 | 80.33 | 8.78 | 7.53 |
| 19.07 | 75.04 | 73.56 | 8.84 | 7.42 |
| 21.78 | 66.98 | 65.53 | 8.90 | 7.31 |
| 24.51 | 59.36 | 57.93 | 8.95 | 7.22 |
| 26.83 | 53.65 | 51.93 | 8.99 | 7.15 |
| 29.97 | 49.56 | 47.82 | 9.00 | 7.06 |
| 32.48 | 46.47 | 44.71 | 9.00 | 7.00 |

Next, the resulted matter was desalted and washed in an ordinary process, and was dispersed in an aqueous solution containing 128.6 g of ossein gelatin. After then, an aggregate amount thereof was adjusted to 3,000 ml with distilled water.

It was observed with an electron microscope that the resulted emulsion was an excellent monodispersed emulsion of 0.27μm in average grain size and of 12% in the variation coefficient of grain size distribution.

(1-3) Provision of the 4th Shell

Emulsion EM-3 was prepared, by using the following 5 kinds of solution, in such a process that the above-mentioned Emulsion EM-2 was used as a seed emulsion to which silver iodobromide shells each having a silver iodide content of 2.6 mol % were provided.

| | |
|---|---|
| (Solution A-3) | |
| Ossein gelatin | 34.0 g |
| Distilled water | 7,779 ml |
| A 10% ethanol solution of sodium polyisopropylene-polyethyleneoxy-disuccinate | 20 ml |
| 4-hydroxy-6-methyl-1,3,3a,7-tetrazaindene | 405 mg |
| A 28% aqueous ammonia | 117.3 ml |
| A 56% aqueous solution of acetic acid | 72 ml |
| Seed emulsion (EM-2) | An equivalent amount to 0.303 mol |
| (Solution B-3) | |
| Ossein gelatin | 18.74 g |
| KBr | 760.2 g |
| KI | 28.4 g |
| 4-hydroxy-6-methyl-1,3,3a,7-tetrazaindene | 1.35 g |
| Distilled water | 1,574 ml |
| (Solution E-3) | |
| $AgNO_3$ | 1,148 g |
| A 28% aqueous ammonia | 937 ml |
| Add distilled water to make | 1,930 ml |
| (Solution F-3) | |
| A 50% aqueous solution of KBr | An amount required for pAg value adjustment. |
| (Solution G-3) | |
| A 56% aqueous solution of acetic acid | An amount required for pH value adjustment. |

Both Solutions of E-3 and B-3 were added to Solution A-3 in a double-jet precipitation method, at 40° C., by making use of a mixing stirrer described in Japanese Patent O.P.I. Publication Nos. 92523/1982 and 92524/1982, by taking a time for 56.5 minutes at a minimum so as not to produce any small grains during the addition thereof. While the double-jet precipitation method was being applied, the pAg and pH values thereof and the adding rates of both Solutions of E-3 and B-3 were controlled as shown in Table 3. The pAg and pH values were controlled by adjusting the flow rates of Solutions F-3, G-3 and B-3 by making use of a roller-tube pump capable of changing flow rates.

Two minutes after the addition of Solution E-3 was completed, the pAg value was adjusted to 10.4 with Solution F-3 and, two minutes after then, the pH value was adjusted to 6.0 with Solution G-3, respectively.

Next, the resulted matter was desalted and washed in an ordinary process, and was dispersed in an aqueous solution containing 128.1 g of ossein gelatin. After then, an aggregate amount thereof was adjusted to 3,000 ml with distilled water.

It was observed with an electron microscope that the resulted emulsion was an excellent monodispersed emulsion of 0.80μm in average grain size and of 10% in the variation coefficient of grain size distribution.

TABLE 3

| Time (min) | Rate of adding solution (ml/min) Solution E-3 | Solution B-3 | pAg | pH |
|---|---|---|---|---|
| 0.00 | 5.77 | 5.49 | 9.0 | 9.00 |
| 9.43 | 10.29 | 9.79 | 9.0 | 8.96 |
| 14.17 | 13.91 | 13.24 | 9.0 | 8.93 |
| 18.88 | 18.96 | 18.04 | 9.0 | 8.88 |
| 23.62 | 25.91 | 24.65 | 9.0 | 8.83 |
| 28.33 | 35.09 | 33.81 | 9.0 | 8.76 |
| 33.05 | 44.20 | 42.92 | 9.0 | 8.66 |
| 37.78 | 53.27 | 52.01 | 9.0 | 8.54 |
| 42.50 | 55.56 | 54.31 | 9.0 | 8.40 |
| 47.23 | 56.37 | 55.12 | 9.0 | 8.27 |
| 51.95 | 58.00 | 56.75 | 9.0 | 8.13 |
| 56.53 | 56.01 | 54.76 | 9.0 | 8.00 |

(1-4) Provision of Highly iodide-containing Shell, Intermediate Shell and the Outermost Shell of the Invention Emulsion EM-4 was prepared, by using the following 7 kinds of solutions, in such a process that the above-mentioned Emulsion EM-3 was used as a seed emulsion to which a highly iodide-containing shell, an intermediate shell and the outermost shell were provided.

| | |
|---|---|
| (Solution A-4) | |
| Ossein gelatin | 22.5 g |
| Distilled water | 6,884 ml |
| A 10% ethanol solution of sodium polyisopropylene-polyethyleneoxy-disuccinate | 20 ml |
| 4-hydroxy-6-methyl-1,3,3a,7-tetrazaindene | Amount shown in Table-4 |
| A 28% aqueous ammonia | 469 ml |
| A 56% aqueous solution of acetic acid | 258 ml |
| Seed emulsion (EM-3) | An equivalent amount to 0.8828 mol |
| (Solution B-4) | |
| Ossein gelatin | 24 g |
| KBr | Amount shown in Table-5 |
| KI | Amount shown in Table-5 |
| 4-hydroxy-6-methyl-1,3,3a,7-tetrazaindene | Amount shown in Table-5 |
| Distilled water | 1,978 ml |
| (Solution C-4) | |
| Ossein gelatin | 24 g |
| KBr | Amount shown in Table-6 |
| KI | Amount shown in Table-6 |
| 4-hydroxy-6-methyl-1,3,3a,7-tetrazaindene | Amount shown in Table-6 |
| Distilled water | 1,978 ml |
| (Solution D-4) | |
| Ossein gelatin | 40 g |
| KBr | Amount shown in Table-7 |
| KI | Amount shown in Table-7 |
| 4-hydroxy-6-methyl-1,3,3a,7-tetrazaindene | Amount shown in Table-7 |
| Distilled water | 3,296 ml |
| (Solution E-4) | |
| $AgNO_3$ | 1,109 g |
| A 28% aqueous ammonia | 904 ml |
| Add distilled water to make | 1,866 ml |
| (Solution F-4) | |
| A 50% aqueous solution of KBr | An amount required for pAg value adjustment |
| (Solution G-4) | |
| A 56% aqueous solution of acetic acid | An amount required for pH value adjustment |

Both Solutions of E-4 and B-4 were added to Solution A-4 in a double-jet precipitation method, at 50° C., by making use of a mixing stirrer described in Japanese Patent O.P.I. Publication Nos. 92523/1982 and 92524/1982, by taking a time for 46.6 minutes. At the same time when the addition of Solution B-4, Solution C-4 was added thereto. After 35.9 minutes, that was at the time when the addition of Solution C-4 was completed, Solution D-4 was added thereto and after 25.5 minutes, the addition of Solution D-4 was completed. While the double-jet precipitation method was being applied, the pAg and pH values thereof and the adding rates of the solutions of E-4, B-4, C-4 and D-4 were controlled as shown in Table-8. The pAg and pH values were controlled by adjusting the flow rates of Solutions F-4 and G-4 by making use of a roller-tube pump capable of changing flow rates.

Two minutes after the addition of Solution E-4 was completed. The pAg value thereof was adjusted to 10.4 by Solution F-4 and, after two minutes, the pH value thereof was further adjusted to 6.0 by Solution G-4, respectively.

Next, the resulted matter was desalted and washed in an ordinary process and was dispersed in an aqueous solution containing 127 g of ossein gelatin. After then, the resulted dispersed matter was adjusted to an aggregate amount of 3,000 ml with distilled water.

It was observed with a electron microscope that the resulted emulsion was an excellent monodispersed emulsion of 1.60μm in average grain size and of 11% in the variation coefficient of grain size distribution.

The emulsion EM-4 is a core/shell type silver iodobromide emulsion having the silver iodide contents of 15 mol %, 5 mol % and 0.3 mol % in the order arranged from the inside of each grain. (i.e., Il=0.3, Ih=15 and Im=5, respectively).

TABLE 4

| Emulsion No. | Content of Solution A-4: 4-hydroxy-6-methyl-1,3,3a,7-tetrazaindene (mg) |
|---|---|
| EM-4 | 646 |
| EM-5 | 646 |
| EM-6 | 646 |
| EM-7 | 646 |
| EM-8 | 646 |
| EM-9 | 646 |
| EM-10 | 646 |
| EM-11 | 646 |
| EM-12 | 646 |
| EM-13 | 646 |
| EM-14 | 646 |
| EM-15 | 646 |
| EM-16 | 646 |
| EM-17 | 646 |
| EM-18 | 646 |
| EM-19 | 646 |
| EM-20 | 646 |
| EM-21 | 646 |
| EM-22 | 646 |
| EM-23 | 646 |
| EM-24 | 646 |
| EM-25 | 646 |
| EM-26 | 646 |
| EM-27 | 646 |
| EM-28 | 323 |
| EM-29 | 323 |
| EM-30 | 323 |
| EM-31 | 323 |
| EM-32 | 646 |
| EM-33 | 646 |
| EM-34 | 646 |
| EM-35 | 646 |
| EM-36 | 646 |
| EM-37 | 646 |
| EM-38 | 646 |
| EM-39 | 646 |

TABLE 5

| Emulsion No. | Content of Solution B-4: 4-hydroxy-6-methyl-1,3,3a,7-tetrazaindene (mg) | KBr (g) | KI (g) | KI/(KBr + KI) mol % |
|---|---|---|---|---|
| EM-4 | 2560 | 848 | 209 | 15 |
| EM-5 | 2560 | 848 | 209 | 15 |
| EM-6 | 2560 | 848 | 209 | 15 |
| EM-7 | 2560 | 848 | 209 | 15 |
| EM-8 | 2560 | 848 | 209 | 15 |
| EM-9 | 2560 | 848 | 209 | 15 |
| EM-10 | 2560 | 948 | 69.7 | 5 |
| EM-11 | 2560 | 918 | 111 | 8 |
| EM-12 | 2560 | 898 | 139 | 10 |
| EM-13 | 2560 | 798 | 278 | 20 |
| EM-14 | 2560 | 698 | 418 | 30 |
| EM-15 | 2560 | 598 | 557 | 40 |
| EM-16 | 2560 | 598 | 557 | 40 |
| EM-17 | 2560 | 498 | 697 | 50 |
| EM-18 | 2560 | 498 | 697 | 50 |
| EM-19 | 2560 | 848 | 209 | 15 |
| EM-20 | 2560 | 848 | 209 | 15 |
| EM-21 | 2560 | 848 | 209 | 15 |
| EM-22 | 2560 | 848 | 209 | 15 |

TABLE 5-continued

| Emulsion No. | Content of Solution B-4: 4-hydroxy-6-methyl-1,3,3a,7-tetra-zaindene (mg) | KBr (g) | KI (g) | KI/(KBr + KI) mol % |
|---|---|---|---|---|
| EM-23 | 2560 | 848 | 209 | 15 |
| EM-24 | 2560 | 848 | 209 | 15 |
| EM-25 | 2560 | 848 | 209 | 15 |
| EM-26 | 2560 | 748 | 348 | 25 |
| EM-27 | 2560 | 848 | 209 | 15 |
| EM-28 | 1280 | 848 | 209 | 15 |
| EM-29 | 1280 | 848 | 209 | 15 |
| EM-30 | 1280 | 848 | 209 | 15 |
| EM-31 | 1280 | 848 | 209 | 15 |
| EM-32 | 2560 | 848 | 209 | 15 |
| EM-33 | 2560 | 848 | 209 | 15 |
| EM-34 | 2560 | 848 | 209 | 15 |
| EM-35 | 2560 | 748 | 348 | 25 |
| EM-36 | 2560 | 648 | 488 | 35 |
| EM-37 | 2560 | 648 | 488 | 35 |
| EM-38 | 2560 | 918 | 111 | 8 |
| EM-39 | 2560 | 918 | 111 | 8 |

TABLE 6

| Emulsion No. | Content of Solution C-4: 4-hydroxy-6-methyl-1,3,3a,7-tetra-zaindene (mg) | KBr (g) | KI (g) | KI/(KBr + KI) mol % |
|---|---|---|---|---|
| EM-4 | 2560 | 948 | 69.7 | 5 |
| EM-5 | 2560 | 848 | 209 | 15 |
| EM-6 | 2560 | 868 | 181 | 13 |
| EM-7 | 2560 | 898 | 139 | 10 |
| EM-8 | 2560 | 978 | 27.9 | 2 |
| EM-9 | 2560 | 996 | 4.18 | 0.3 |
| EM-10 | 2560 | 948 | 69.7 | 5 |
| EM-11 | 2560 | 948 | 69.7 | 5 |
| EM-12 | 2560 | 948 | 69.7 | 5 |
| EM-13 | 2560 | 948 | 69.7 | 5 |
| EM-14 | 2560 | 948 | 69.7 | 5 |
| EM-15 | 2560 | 948 | 69.7 | 5 |
| EM-16 | 2560 | 996 | 4.18 | 0.3 |
| EM-17 | 2560 | 948 | 69.7 | 5 |
| EM-18 | 2560 | 996 | 4.18 | 0.3 |
| EM-19 | 2560 | 948 | 69.7 | 5 |
| EM-20 | 2560 | 948 | 69.7 | 5 |
| EM-21 | 2560 | 948 | 69.7 | 5 |
| EM-22 | 2560 | 948 | 69.7 | 5 |
| EM-23 | 2560 | 898 | 139 | 10 |
| EM-24 | 2560 | 898 | 139 | 10 |
| EM-25 | 2560 | 898 | 139 | 10 |
| EM-26 | 2560 | 828 | 237 | 17 |
| EM-27 | 2560 | 948 | 69.7 | 5 |
| EM-28 | 1280 | 948 | 69.7 | 5 |
| EM-29 | 1280 | 996 | 4.18 | 0.3 |
| EM-30 | 1280 | 948 | 69.7 | 5 |
| EM-31 | 1280 | 996 | 4.18 | 0.3 |
| EM-32 | 2560 | 948 | 69.7 | 5 |
| EM-33 | 2560 | 948 | 69.7 | 5 |
| EM-34 | 2560 | 948 | 69.7 | 5 |
| EM-35 | 2560 | 898 | 139 | 10 |
| EM-36 | 2560 | 898 | 139 | 10 |
| EM-37 | 2560 | 924 | 104 | 7.5 |
| EM-38 | 2560 | 956 | 55.7 | 4 |
| EM-39 | 2560 | 996 | 4.18 | 0.3 |

TABLE 7

| Emulsion No. | Content of Solution D-4: 4-hydroxy-6-methyl-1,3,3a,7-tetra-zaindene (mg) | KBr (g) | KI (g) | KI/(KBr + KI) mol % |
|---|---|---|---|---|
| EM-4 | 4268 | 1660 | 6.97 | 0.3 |
| EM-5 | 4268 | 1660 | 6.97 | 0.3 |
| EM-6 | 4268 | 1660 | 6.97 | 0.3 |
| EM-7 | 4268 | 1660 | 6.97 | 0.3 |
| EM-8 | 4268 | 1660 | 6.97 | 0.3 |
| EM-9 | 4268 | 1660 | 6.97 | 0.3 |
| EM-10 | 4268 | 1660 | 6.97 | 0.3 |

TABLE 7-continued

| Emulsion No. | Content of Solution D-4: 4-hydroxy-6-methyl-1,3,3a,7-tetra-zaindene (mg) | KBr (g) | KI (g) | KI/(KBr + KI) mol % |
|---|---|---|---|---|
| EM-11 | 4268 | 1660 | 6.97 | 0.3 |
| EM-12 | 4268 | 1660 | 6.97 | 0.3 |
| EM-13 | 4268 | 1660 | 6.97 | 0.3 |
| EM-14 | 4268 | 1660 | 6.97 | 0.3 |
| EM-15 | 4268 | 1660 | 6.97 | 0.3 |
| EM-16 | 4268 | 1660 | 6.97 | 0.3 |
| EM-17 | 4268 | 1660 | 6.97 | 0.3 |
| EM-18 | 4268 | 1660 | 6.97 | 0.3 |
| EM-19 | 4268 | 1660 | 0 | 0 |
| EM-20 | 4268 | 1657 | 11.6 | 0.5 |
| EM-21 | 4268 | 1641 | 34.8 | 1.5 |
| EM-22 | 4268 | 1591 | 104 | 4.5 |
| EM-23 | 4268 | 1641 | 34.8 | 1.5 |
| EM-24 | 4268 | 1591 | 104 | 4.5 |
| EM-25 | 4268 | 1532 | 185 | 8 |
| EM-26 | 4268 | 1482 | 255 | 11 |
| EM-27 | 4268 | 1660 | 6.97 | 0.3 |
| EM-28 | 2134 | 1660 | 6.97 | 0.3 |
| EM-29 | 2134 | 1660 | 6.97 | 0.3 |
| EM-30 | 2134 | 1660 | 6.97 | 0.3 |
| EM-31 | 2134 | 1660 | 6.97 | 0.3 |
| EM-32 | 4268 | 1660 | 6.97 | 0.3 |
| EM-33 | 4268 | 1660 | 6.97 | 0.3 |
| EM-34 | 4268 | 1660 | 6.97 | 0.3 |
| EM-35 | 4268 | 1581 | 115 | 5 |
| EM-36 | 4268 | 1581 | 115 | 5 |
| EM-37 | 4268 | 1581 | 115 | 5 |
| EM-38 | 4268 | 1660 | 6.97 | 0.3 |
| EM-39 | 4268 | 1660 | 6.97 | 0.3 |

TABLE 8

| Time (min) | Rate of adding solution (ml/min): E-4 | B-4 | C-4 | D-4 | pAg | pH |
|---|---|---|---|---|---|---|
| 0.00 | 7.07 | 7.00 | — | — | 8.70 | 9.00 |
| 18.00 | 8.89 | 8.80 | — | — | 8.70 | 9.00 |
| 27.00 | 9.75 | 9.65 | — | — | 8.70 | 9.00 |
| 36.00 | 10.55 | 10.45 | — | — | 8.70 | 9.00 |
| 45.00 | 11.29 | 11.18 | — | — | 8.70 | 9.00 |
| 46.60 | 11.51 | 11.40 | 11.40 | — | 8.70 | 9.00 |
| 54.80 | 16.44 | — | 18.12 | — | 8.93 | 8.86 |
| 63.05 | 21.38 | — | 24.73 | — | 9.30 | 8.66 |
| 72.05 | 32.84 | — | 60.87 | — | 9.96 | 8.31 |
| 75.50 | 26.31 | — | 54.69 | — | 10.19 | 8.21 |
| 82.50 | 24.12 | — | 23.88 | 23.88 | 10.20 | 8.04 |
| 90.06 | 21.89 | — | — | 21.67 | 10.20 | 7.86 |
| 99.08 | 20.13 | — | — | 19.93 | 10.20 | 7.66 |
| 108.00 | 19.25 | — | — | 19.06 | 10.20 | 7.50 |

PREPARATION EXAMPLE 2

The emulsions, EM-5, EM-6, EM-7, EM-8 and EM-9, were prepared in the same manner as in (1-4) of the above-mentioned preparation example, except that there used the 7 kinds of solutions described in (1-4) of the preparation example and added KBr, KI and 4-hydroxy-6-methyl-1,3,3a,7-tetrazaindene in the amounts designated in Tables 4, 5, 6 and 7, respectively.

The resulted emulsions were the monodispersed emulsions each of 1.60μm in average grain size and their variation coefficients of grain size distribution were 17%, 15%, 12%, 16% and 16%, respectively.

PREPARATION EXAMPLE 3

The emulsions, EM-10 through EM-26, were prepared in the same manner as in (1-4) of the Preparation Example 1, except that the 7 kinds of solutions designated in the Preparation Example 1 and, KBr, KI and 4-hydroxy-6-methyl-1,3,3a,7-tetrazaindene were used in the amounts designated in Tables 4, 5, 6 and 7, respectively.

These emulsions were the monodispersed having the average grain size of 1.60μm and the variation coefficients of the grain size distributions of 10%, 10%, 11%, 12%, 13%, 18%, 19%, 35%, 39%, 10%, 11%, 11%, 11%, 12%, 12%, 12% and 13%, respectively.

PREPARATION EXAMPLE 4

The emulsions, EM-28 and EM-29, were prepared in the same manner as in (1-4) of the preparation Example 1, except that the 7 kinds of solutions designated in the Preparation Example 1 and, KBr, KI and 4-hydroxy-6-methyl-1,3,3a,7-tetrazaindene were used in the amounts designated in Tables 4, 5, 6 and 7, respectively.

Further, the Emulsion EM-27 was prepared in such a manner that the pAg and pH values and adding rates thereof were changed to those designated in Table-9 in the course of the mixation thereof; and the Emulsions EM-30 and 31 were also prepared as shown in Table-10.

The above-mentioned emulsions were the monodispersed having the average grain size of 1.6μm and the variation coefficients of the grain size distributions of 9%, 18%, 19%, 32% and 34%, respectively.

TABLE 9

| | Rate of adding solution (ml/min) | | | | | |
|---|---|---|---|---|---|---|
| Time (min) | E-4 | B-4 | C-4 | D-4 | pAg | pH |
| 0.00 | 7.07 | 7.00 | — | — | 8.70 | 9.00 |
| 18.00 | 8.89 | 8.80 | — | — | 8.70 | 9.00 |
| 27.00 | 9.75 | 9.65 | — | — | 8.70 | 9.00 |
| 36.00 | 10.55 | 10.45 | — | — | 8.70 | 9.00 |
| 45.00 | 11.29 | 11.18 | — | — | 8.70 | 9.00 |
| 46.60 | 11.51 | 11.40 | 11.40 | — | 8.70 | 9.00 |
| 54.80 | 16.44 | — | 18.12 | — | 8.93 | 8.86 |
| 63.05 | 21.38 | — | 24.73 | — | 9.30 | 8.66 |
| 72.05 | 32.84 | — | 60.87 | — | 9.96 | 8.31 |
| 75.50 | 26.31 | — | 54.69 | — | 10.00 | 8.21 |
| 82.50 | 24.12 | — | 23.88 | 23.88 | 10.00 | 8.04 |
| 90.06 | 21.89 | — | — | 21.67 | 10.00 | 7.86 |
| 99.08 | 20.13 | — | — | 19.93 | 10.00 | 7.66 |
| 108.00 | 19.25 | — | — | 19.06 | 10.00 | 7.50 |

TABLE 10

| | Rate of adding solution (ml/min) | | | | | |
|---|---|---|---|---|---|---|
| Time (min) | E-4 | B-4 | C-4 | D-4 | pAg | pH |
| 0.00 | 7.07 | 7.00 | — | — | 10.20 | 9.00 |
| 18.00 | 8.89 | 8.80 | — | — | 10.20 | 9.00 |
| 27.00 | 9.75 | 9.65 | — | — | 10.20 | 9.00 |
| 36.00 | 10.55 | 10.45 | — | — | 10.20 | 9.00 |
| 45.00 | 11.29 | 11.13 | — | — | 10.20 | 9.00 |
| 46.60 | 11.51 | 11.40 | 11.40 | — | 10.20 | 9.00 |
| 54.80 | 16.44 | — | 18.12 | — | 10.20 | 8.86 |
| 63.05 | 21.38 | — | 24.73 | — | 10.20 | 8.66 |
| 72.05 | 32.84 | — | 60.87 | — | 10.20 | 8.31 |
| 75.50 | 26.31 | — | 54.69 | — | 10.20 | 8.21 |
| 82.50 | 24.12 | — | 23.88 | 23.88 | 10.20 | 8.04 |
| 90.06 | 21.89 | — | — | 21.67 | 10.20 | 7.86 |
| 99.08 | 20.13 | — | — | 19.93 | 10.20 | 7.66 |
| 108.00 | 19.25 | — | — | 19.06 | 10.20 | 7.50 |

PREPARATION EXAMPLE 5

The emulsion EM-32 was prepared in the same manner as in (1-4) of the Preparation Example 1, except that the 7 kinds of solutions designated in the Preparation Example 1 and, KBr, KI and 4-hydroxy-6-methyl-1,3,3a,7-tetrazaindene were used in the amounts designated in Tables 4, 5, 6 and 7, respectively, and the pAg and pH values and adding rates of E-4, B-4, C-4 and D-4 thereof were further changed to those designated in Table-11 in the course of the mixation thereof; and the Emulsion EM-33 was prepared as shown in Table-12, and Emulsion EM-34 was further prepared as shown in Table-13, respectively. The above-mentioned emulsions were the monodispersed having the average grain size of 1.6μm and the variation coefficients of the grain size distributions of 10%, 10% and 12%, respectively.

TABLE 11

| | Rate of adding solution (ml/min) | | | | | |
|---|---|---|---|---|---|---|
| Time (min) | E-4 | B-4 | C-4 | D-4 | pAg | pH |
| 0.00 | 7.07 | 7.00 | — | — | 8.70 | 9.00 |
| 18.00 | 8.89 | 8.80 | — | — | 8.70 | 9.00 |
| 27.00 | 9.75 | 9.65 | — | — | 8.70 | 9.00 |
| 28.50 | 9.89 | 9.80 | 9.80 | — | 8.70 | 9.00 |
| 36.00 | 10.55 | — | 10.45 | — | 8.70 | 9.00 |
| 45.00 | 11.29 | — | 11.18 | — | 8.70 | 9.00 |
| 46.60 | 11.51 | — | 11.40 | — | 8.70 | 9.00 |
| 54.80 | 16.44 | — | 18.12 | — | 8.93 | 3.86 |
| 63.05 | 21.38 | — | 24.73 | — | 9.30 | 8.66 |
| 72.05 | 32.84 | — | 60.87 | — | 9.96 | 8.31 |
| 75.50 | 26.31 | — | 54.69 | — | 10.19 | 8.21 |
| 82.50 | 24.12 | — | 23.88 | 23.88 | 10.20 | 8.04 |
| 90.06 | 21.89 | — | — | 21.67 | 10.20 | 7.86 |
| 99.08 | 20.13 | — | — | 19.93 | 10.20 | 7.66 |
| 108.00 | 19.25 | — | — | 19.06 | 10.20 | 7.50 |

TABLE 12

| | Rate of adding solution (ml/min) | | | | | |
|---|---|---|---|---|---|---|
| Time (min) | E-4 | B-4 | C-4 | D-4 | pAg | pH |
| 0.00 | 7.07 | 7.00 | — | — | 8.70 | 9.00 |
| 13.90 | 8.47 | 8.39 | 8.39 | — | 8.70 | 9.00 |
| 18.00 | 9.75 | — | 9.65 | — | 8.70 | 9.00 |
| 27.00 | 9.89 | — | 9.80 | — | 8.70 | 9.00 |
| 36.00 | 10.55 | — | 10.45 | — | 8.70 | 9.00 |
| 45.00 | 11.29 | — | 11.18 | — | 8.70 | 9.00 |
| 46.60 | 11.51 | — | 11.40 | — | 8.70 | 9.00 |
| 54.80 | 16.44 | — | 18.12 | — | 8.93 | 8.86 |
| 63.05 | 21.38 | — | 24.73 | — | 9.30 | 8.66 |
| 72.05 | 32.84 | — | 60.87 | — | 9.96 | 8.31 |
| 75.50 | 26.31 | — | 54.69 | — | 10.19 | 8.21 |
| 82.50 | 24.12 | — | 23.88 | 23.88 | 10.20 | 8.04 |
| 90.06 | 21.89 | — | — | 21.67 | 10.20 | 7.86 |
| 99.08 | 20.13 | — | — | 19.93 | 10.20 | 7.66 |
| 108.00 | 19.25 | — | — | 19.06 | 10.20 | 7.50 |

TABLE 13

| | Rate of adding solution (ml/min) | | | | | |
|---|---|---|---|---|---|---|
| Time (min) | E-4 | B-4 | C-4 | D-4 | pAg | pH |
| 0.00 | 7.07 | 7.00 | — | — | 8.70 | 9.00 |
| 18.00 | 8.89 | 8.80 | — | — | 8.70 | 9.00 |
| 27.00 | 9.75 | 9.65 | — | — | 8.70 | 9.00 |
| 36.00 | 10.55 | 10.45 | — | — | 8.70 | 9.00 |
| 45.00 | 11.29 | 11.18 | — | — | 8.70 | 9.00 |
| 46.60 | 11.51 | 11.40 | — | — | 8.70 | 9.00 |
| 54.80 | 16.44 | 18.12 | — | — | 8.93 | 8.86 |
| 63.05 | 21.38 | 24.73 | — | — | 9.30 | 8.66 |
| 68.85 | 28.76 | 48.02 | 48.02 | — | 9.72 | 8.43 |
| 72.05 | 32.84 | — | 60.87 | — | 9.96 | 8.31 |
| 75.50 | 26.31 | — | 54.69 | — | 10.19 | 8.21 |
| 82.50 | 24.12 | — | 23.88 | 23.88 | 10.20 | 8.04 |
| 90.06 | 21.89 | — | — | 21.67 | 10.20 | 7.86 |
| 99.08 | 20.13 | — | — | 19.93 | 10.20 | 7.66 |
| 108.00 | 19.25 | — | — | 19.06 | 10.20 | 7.50 |

PREPARATION EXAMPLE 6

The emulsions EM-35, EM-36 and EM-37 were prepared in the same manner as in (1-4) of the Preparation Example 1, except that the 7 kinds of solutions designated in the Preparation Example 1 and, KBr, KI and 4-hydroxy-6 methyl-1,3,3a,7-tetrazaindene were used in the amounts designated in Tables 4, 5, 6 and 7, respectively.

Further, the Emulsions EM-38 and EM-39 were prepared in such a manner that the pAg and pH values and adding rates of E-4, B-4, C-4 and D-4 thereof were changed to those designated in Table 12 in the course of the mixation thereof.

The above-prepared emulsions were the monodispersed having the average grain size of 1.6μm and variation coefficients of the grain size distributions of 12%, 14%, 13%, 9% and 11%, respectively.

The composition of the above-mentioned emulsions will be shown in the following Table-14 through Table-19.

TABLE 14

| EM-No. | Ih mol % | Im mol % | Il mol % | ΔI = Ih − Il mol % | ΔIh = Ih − Im mol % | ΔTl = Im − Il mol % | Whole content of iodide % | Volume of each shell Vh % | Vm % | Vl % | Veriation coefficient % |
|---|---|---|---|---|---|---|---|---|---|---|---|
| Em-5 (Other than Invention) | 15 | 15 | 0.3 | 14.7 | 0 | 14.7 | 9.5 | 22 | 39 | 27 | 17 |
| EM-6 (Other then Invention) | 15 | 13 | 0.3 | 14.7 | 2 | 12.7 | 8.7 | 22 | 39 | 27 | 15 |
| EM-7 (Invention) | 15 | 10 | 0.3 | 14.7 | 5 | 9.7 | 7.5 | 22 | 39 | 27 | 12 |
| EM-8 (Other than Invention) | 15 | 2 | 0.3 | 14.7 | 13 | 1.7 | 4.4 | 22 | 39 | 27 | 16 |
| EM-9 (Other than Invention) | 15 | 0.3 | 0.3 | 14.7 | 14.7 | 0 | 3.8 | 22 | 39 | 27 | 16 |

TABLE 15

| EM-No. | Ih mol % | Im mol % | Il mol % | ΔI = Ih − Il mol % | ΔIh = Ih − Im mol % | ΔTl = Im − Il mol % | Whole content of iodide % | Volume of each shell Vh % | Vm % | Vl % | Veriation coefficient % |
|---|---|---|---|---|---|---|---|---|---|---|---|
| EM-10 (Other than Invention) | 5 | 5 | 0.3 | 4.7 | 0 | 4.7 | 3.4 | 22 | 39 | 27 | 10 |
| EM-11 (Invention) | 8 | 5 | 0.3 | 7.7 | 3 | 4.7 | 4.1 | 22 | 39 | 27 | 10 |
| EM-12 (Invention) | 10 | 5 | 0.3 | 9.7 | 5 | 4.7 | 4.5 | 22 | 39 | 27 | 11 |
| EM-13 (Invention) | 20 | 5 | 0.3 | 19.7 | 15 | 4.7 | 6.7 | 22 | 39 | 27 | 12 |
| EM-14 (Invention) | 30 | 5 | 0.3 | 29.7 | 25 | 4.7 | 8.8 | 22 | 39 | 27 | 13 |
| EM-15 (Invention) | 40 | 5 | 0.3 | 39.7 | 35 | 4.7 | 11.1 | 22 | 39 | 27 | 18 |
| EM-16 (Other than Invention) | 40 | 0.3 | 0.3 | 39.7 | 39.7 | 0 | 9.2 | 22 | 39 | 27 | 19 |
| EM-17 (Invention) | 50 | 5 | 0.3 | 49.7 | 45 | 4.7 | 12.2 | 22 | 39 | 27 | 35 |
| EM-18 (Other than Invention) | 50 | 0.3 | 0.3 | 49.7 | 49.7 | 0 | 11.4 | 22 | 39 | 27 | 39 |

TABLE 16

| EM-No. | Ih mol % | Im mol % | Il mol % | ΔI = Ih − Il mol % | ΔIh = Ih − Im mol % | ΔTl = Im − Il mol % | Whole content of iodide % | Volume of each shell Vh % | Vm % | Vl % | Veriation coefficient % |
|---|---|---|---|---|---|---|---|---|---|---|---|
| EM-19 (Invention) | 15 | 5 | 0 | 15 | 10 | 5 | 5.5 | 22 | 39 | 27 | 10 |
| EM-20 (Invention) | 15 | 5 | 0.5 | 14.5 | 10 | 4.5 | 5.7 | 22 | 39 | 27 | 11 |
| EM-21 (Invention) | 15 | 5 | 1.5 | 13.5 | 10 | 3.5 | 5.9 | 22 | 39 | 27 | 11 |
| EM-22 (Other than Invention) | 15 | 5 | 4.5 | 10.5 | 10 | 0.5 | 6.7 | 22 | 39 | 27 | 11 |
| EM-23 | 15 | 10 | 1.5 | 13.5 | 5 | 8.5 | 7.9 | 22 | 39 | 27 | 12 |

TABLE 16-continued

| EM-No. | Ih mol % | Im mol % | Il mol % | ΔI = Ih − Il mol % | ΔIh = Ih − Im mol % | ΔTl = Im − Il mol % | Whole content of iodide % | Volume of each shell Vh % | Vm % | Vl % | Veriation coefficient % |
|---|---|---|---|---|---|---|---|---|---|---|---|
| (Invention) | | | | | | | | | | | |
| EM-24 (Invention) | 15 | 10 | 4.5 | 10.5 | 5 | 5.5 | 8.7 | 22 | 39 | 27 | 12 |
| EM-25 (Other than Invention) | 15 | 10 | 8 | 7 | 5 | 2 | 9.6 | 22 | 39 | 27 | 12 |
| EM-26 (Other than Invention) | 25 | 17 | 11 | 14 | 8 | 6 | 15.3 | 22 | 39 | 27 | 13 |

TABLE 17

| EM-No. | Ih mol % | Im mol % | Il mol % | ΔI = Ih − Il mol % | ΔIh = Ih − Im mol % | ΔTl = Im − Il mol % | Whole content of iodide % | Volume of each shell Vh % | Vm % | Vl % | Veriation coefficient % |
|---|---|---|---|---|---|---|---|---|---|---|---|
| EM-27 (Invention) | 15 | 5 | 0.3 | 14.7 | 10 | 4.7 | 5.6 | 22 | 39 | 27 | 9 |
| EM-28 (Invention) | 15 | 5 | 0.3 | 14.7 | 10 | 4.7 | 5.6 | 22 | 39 | 27 | 18 |
| EM-29 (Other than Invention) | 15 | 0.3 | 0.3 | 14.7 | 14.7 | 0 | 3.8 | 22 | 39 | 27 | 19 |
| EM-30 (Invention) | 15 | 5 | 0.3 | 14.7 | 10 | 4.7 | 5.6 | 22 | 39 | 27 | 32 |
| EM-31 (Other than Invention | 15 | 0.3 | 0.3 | 14.7 | 14.7 | 0 | 3.8 | 22 | 39 | 27 | 34 |

TABLE 18

| EM-No. | Ih mol % | Im mol % | Il mol % | ΔI = Ih − Il mol % | ΔIh = Ih − Im mol % | ΔTl = Im − Il mol % | Whole content of iodide % | Volume of each shell Vh % | Vm % | Vl % | Veriation coefficient % |
|---|---|---|---|---|---|---|---|---|---|---|---|
| EM-32 (Invention) | 15 | 5 | 0.3 | 14.7 | 10 | 4.7 | 4.6 | 12 | 49 | 27 | 10 |
| EM-33 (Invention) | 15 | 5 | 0.3 | 14.7 | 10 | 4.7 | 4.0 | 5 | 56 | 27 | 10 |
| EM-34 (Invention) | 15 | 5 | 0.3 | 14.7 | 10 | 4.7 | 7.6 | 41 | 20 | 27 | 12 |

TABLE 19

| EM-No. | Ih mol % | Im mol % | Il mol % | ΔI = Ih − Il mol % | ΔIh = Ih − Im mol % | ΔTl = Im − Il mol % | Whole content of iodide % | Volume of each shell Vh % | Vm % | Vl % | Veriation coefficient % |
|---|---|---|---|---|---|---|---|---|---|---|---|
| EM-35 (Invention) | 25 | 10 | 5 | 20 | 15 | 5 | 11 | 22 | 39 | 27 | 12 |
| EM-36 (Invention) | 35 | 10 | 5 | 30 | 25 | 5 | 13.7 | 22 | 39 | 27 | 14 |
| EM-37 (Other than Invention) | 35 | 7.5 | 5 | 30 | 27.5 | 2.5 | 12.2 | 22 | 39 | 27 | 13 |
| EM-33 (Invention) | 15 | 5 | 0.3 | 14.7 | 10 | 4.7 | 4.0 | 5 | 56 | 27 | 10 |
| EM-38 (Invention) | 8 | 4 | 0.3 | 7.7 | 4 | 3.7 | 1.6 | 5 | 56 | 27 | 9 |
| EM-39 (Other than Invention) | 8 | 0.3 | 0.3 | 7.7 | 7.7 | 0 | 1.0 | 5 | 56 | 27 | 11 |

The preparation and the property of the photographic light-sensitive material using the above-described silver halide grains will now be described further in detail.

EXAMPLE 1

Emulsion [EX-1]:

The aforementioned emulsion EM-5 (containing 0.35% mol of a silver halide and 40 g of gelatin each per kg of the emulsion) in an amount of 1 kg was chemically sensitized with a gold and sulfur sensitizer, and whereto a green-sensitive spectral sensitizer that was anhydro-5,5'-diphenyl-9-ethyl-3,3'-di--(3-sulfobutyl)oxacarbocyanine hydroxide and then 0.25 g of 4-hydroxy-6-methyl-1.3.3a.7-tetrazaindene and 20 mg of 1-phenyl-5-mercaptotetrazole were added, respectively.

Next, there prepared a dispersed matter [(MX-1)] which was to be mixed up with the above-mentioned sensitized emulsion and to be coated on, in the following manner.

Dispersed Matter [(MX-1)]:

Twenty (20) grams of a comparative magenta coupler, i.e., 1-(2,4,6-trichlorophenyl)-3-[3-(2,4-di-t-amylphenoxyacetamido)-benzamido]-5-pyrazolone and 5 g of a colored magenta coupler (CM-1), i.e., 1-(2,4,6-trichlorophenyl)-4-(1-naphthylazo)-3--(2-chloro-5-octadecenylsuccinimidoanilino)-5-pyrazolone were dissolved in a mixture of 25 g of tricresyl phosphate (hereinafter called TCP) and 100 ml of ethyl acetate (hereinafter called EA), and the resulted solution was added to 300 ml of an aqueous solution of 7.5% gelatin containing 4 g of sodium isopropylnaphthalenesulfonate and was then emulsified and dispersed by making use of a colloid mill, so that 500 ml of [(MX-1)] was prepared.

Each of the emulsions ES-2 through 6 and the dispersed matters MX-2 through 3 was similarly prepared, except that the silver halide grains and the magenta couplers only were changed to those shown in Table-20.

Sample 1 (Immediately prepared):

A coating liquid was prepared by adding 500 ml of the above-mentioned dispersed matter [(MX-1)] to every 1 kg of the aforementioned sensitized emulsion EX-1. Immediately after the preparation thereof, it was coated over to a cellulose triacetate film support so that the silver content may be 18 mg per $dm^2$.

Sample 2 (Retardingly prepared)

The coating liquid prepared in the same manner as in Sample 1 was coated on so that the silver content may be 18 mg per $dm^2$ after retardation for 2 hours at 42° C.

The immediately prepared samples and the retardingly prepared samples were similarly prepared by making use of each of the coating liquids, respectively, as shown in Table-21.

The respective samples were exposed to white light through a wedge and processed in the following treatments 1 and 2 and then developed in the following steps.

Treatment 1:

Each sample was retained at 30° C. for 3 days in a tightly closed vessel into which a liquid containing 300 ml of an aqueous solution of 35% glycerol was placed on the bottom and the air equilibrated thereto was filled up.

Treatment 2:

Each sample was retained at 30° C. for 3 days in a tightly closed vessel into which a liquid containing both aqueous solutions of 40% formaldehyde and 35% glycerol in the proportion of 300 ml of the former to 6 ml of the latter was placed on the bottom, and the air equilibrated thereto was filled up.

| Processing step: | |
|---|---|
| Color-developing | 3 min. 15 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |
| Drying | |

The composition of the processing liquids used in the above-mentioned processing steps are shown below:

| | |
|---|---|
| [Color developer] | |
| 4-amino-3-methyl-N-(β-hydroxyethyl)-aniline.sulfate | 4.75 g |
| Sodium sulfite, anhydrated | 4.25 g |
| Hydroxylamine ½ sulfate | 2.0 g |
| Potassium carbonate, anhydrated | 37.5 g |
| Sodium bromide | 1.3 g |
| Trisodium nitrilotriacetate, monohydrated | 2.5 g |
| Potassium hydroxide | 1.0 g |
| Add water to make | 1 liter |
| [Bleaching liquid] | |
| Iron ammonium ethylene-diaminetetraacetate | 100.0 g |
| Diammonium ethylenediamninetetraacetate | 10.0 g |
| Ammonium bromide | 150.0 g |
| Glacial acetic acid | 10.0 ml |
| Add water to make | 1 liter |
| Adjust the pH value with aqueous ammonia to pH | 6.0 |
| [Fixing liquid] | |
| Ammonium thiosulfate | 175.0 g |
| Ammonium sulfite, anhydrated | 8.5 g |
| Sodium metasulfite | 2.3 g |
| Add water to make | 1 liter |
| Adjust the pH value with acetic acid to pH | 6.0 |
| [Stabilizing liquid] | |
| Formalin (a 37% aqueous solution) | 1.5 ml |
| Konidax (mfd. by Konishiroku Photo Ind. Co., Ltd., Japan.) | 7.5 ml |
| Add water to make | 1 liter |

Table-21 exhibits the sensitometric data of a green-sensitive silver halide emulsion layers thus obtained.

TABLE 20

| Emulsion liquid | Emulsion | Dispersed liquid | Magenta coupler |
|---|---|---|---|
| EX-2 | EM-10 | MX-2 | Exemplified compound 5 |
| EX-3 | EM-18 | MX-3 | Exemplified compound 99 |
| EX-4 | EM-7 | | |
| EX-5 | EM-27 | | |
| EX-6 | EM-34 | | |

TABLE 21

| Sample No. | | Emulsion liquid | Dispersed liquid | Treatment-I: Immediately prepared | Treatment-I: Retardingly prepared | Fog | Sensitivity | Variation % |
|---|---|---|---|---|---|---|---|---|
| Comparative | 1 | EX-1 | MX-1 | O | | 0.21 | 100 | 65% |
| | 2 | " | " | | O | 0.25 | 92 | 60% |
| | 3 | EX-2 | MX-2 | O | | 0.22 | 104 | 95% |
| | 4 | " | " | | O | 0.25 | 82 | 87% |
| | 5 | EX-3 | " | O | | 0.21 | 103 | 95% |
| | 6 | " | " | | O | 0.25 | 78 | 88% |
| | 7 | " | MX-3 | O | | 0.21 | 103 | 94% |
| | 8 | " | " | | O | 0.24 | 75 | 89% |
| | 9 | EX-4 | MX-1 | O | | 0.18 | 150 | 65% |
| | 10 | " | " | | O | 0.20 | 141 | 62% |
| Invention | 11 | " | MX-2 | O | | 0.16 | 152 | 95% |
| | 12 | " | " | | O | 0.16 | 150 | 95% |
| | 13 | EX-5 | " | O | | 0.16 | 153 | 93% |
| | 14 | " | " | | O | 0.15 | 151 | 93% |
| | 15 | " | MX-3 | O | | 0.15 | 151 | 97% |
| | 16 | " | " | | O | 0.15 | 151 | 96% |
| | 17 | EX-6 | MX-2 | O | | 0.15 | 146 | 95% |
| | 18 | " | " | | O | 0.15 | 144 | 94% |
| | 19 | " | MX-3 | O | | 0.15 | 146 | 98% |
| | 20 | " | " | | O | 0.15 | 144 | 98% |

*Sensitivity indicates those of the samples in the terms of a value relative to the sensitivity (regarded as 100) of the immediately prepared Sample-1.
*Variation % indicates a value of (a maximum density of magenta color processed in Treatment-1/ a maximum density of magenta color processed in Treatment-2) × 100.

As is obvious from the results, it is understood that, according to the invention, the coating liquid is excellent in retarding stability and is also quite satisfactory in formalin gas resistance.

EXAMPLE 2

Sample No. 2-1 was prepared by coating the following layers in order over to a transparent sublayered cellulose triacetate film support bearing thereon an antihalation layer containing 0.40 g of black colloidal silver and 3.0 g of gelatin.

[Sample No. 2-1] . . . Comparative Example

Layer 1: A lower sensitive layer of a red-sensitive silver halide emulsion layer (RL-1)

This layer contains a dispersed matter prepared in a process that an emulsion comprising AgBrI containing Ag of 17 mol % (hereinafter called Emulsion 1) was red-sensitized, and 18 g of the resulted emulsion, 0.8 g of 1-hydroxy-4-(β-methoxy-ethylaminocarbonylmethoxy-)-N-[δ-2,4-di-t-amylphenoxy)butyl]-2--naphthamido (hereinafter called C-1), 0.075 g of 1-hydroxy-4- -[4-(1-hydroxy-8-acetamido-3,6-disulfo-2-naphthylazo)-phenoxy]-N-[δ-(2,4-di-t-amylphenoxy)butyl]-2-naphthamido disodium (hereinafter called CC-1), 0.015 g of 1-hydroxy-2-[δ-(2,4-di-t-amylphenoxy)-n-butyl]naphthamide, and 0.07 g of 4-octadecylsuccinimido-2-(1-phenyl-5-tetrazolylthio)-1-indanone (hereinafter called D-1) were dissolved in 0.65g of tricresyl phosphate (hereinafter called TCP); and the resulted solution was emulsified and dispersed in an aqueous solution containing 1.85g of gelation, so that the dispersed matter was obtained.

Layer 2: A highly sensitive layer of the red-sensitive silver halide emulsion layer (RH-1)

This layer contains a dispersed matter prepared in a process that an emulsion comprising AgBrI containing Ag of 16 mol % (hereinafter called Emulsion II) was red-sensitized, and 1.2g of the resulted emulsion, 0.21g of cyan coupler (C-1) and 0.02g of colored cyan coupler (CC-1) were dissolved in 0.23g of TCP, and the resulted solution was emulsified and dispersed in an aqueous solution containing 1.2 g of gelatin, so that the dispersed matter may be obtained.

Layer 3: An interlayer (IL)

This layer contains 0.04 g of dibutyl phthalate (hereinafter called DBP) in which 0.8 g of gelatin and 0.07 g of 2,5-di-t-octylhydroquinone (hereinafter called HQ-1) were dissolved.

Layer 4: A low sensitive layer of a green-sensitive silver halide emulsion layer (GL-1)

This layer contains a dispersed matter prepared in a process that an emulsion having the same composition and crystal habit as those of EM-6 but having a grain size changed to 0.8 μ was green-sensitized, and 0.80g of the resulted emulsion, 0.80g of Exemplified Compound (13) and 0.01 g of the DIR Compound (D-1) were dissolved in dinonylphenol, and then 0.95g of the resulted dinonylphenol solution were emulsified and dispersed in an aqueous solution containing 2.2g of gelatin, so that the dispersed matter was prepared.

Layer 5: A highly sensitive layer of the green-sensitive silver halide emulsion layer (GH-1)

This layer contains a dispersed matter prepared in a process that the EM-6 was green-sensitized, and 1.8g of the resulted emulsion and 0.20g of the Exemplified Compound (13) were dissolved in dinonylphenol, and then 0.25g of the resulted dinonylphenol solution were emulsified and dispersed in an aqueous solution containing 1.9g of gelatin, so that the dispersed matter was prepared.

Layer 6: A yellow filter layer (YF)

This layer contains 0.15 g of yellow colloidal silver, 0.11 g of DBP in which 0.2 g of an anticolor-staining agent (HQ-1) were dissolved and 1.5 g of gelatin.

Layer 7: A low sensitive layer of a blue-sensitive silver halide emulsion layer (BL-1)

This layer contains a dispersed matter prepared in a process that Emulsion I was blue-sensitized, and 0.2g of the resulted emulsion and 1.5g of α-pivaloyl-α-(1-benzyl-2-phenyl-3,5-dioxineimidazolidine-4-yl)-2-chloro-5-[α-dodecyloxycarbonyl)ethoxycarbonyl]acetanilide (hereinafter called Y-1) were dissolved in TCP, and then 0.8g of the resulted TCP solution were emulsified and dispersed in an aqueous solution containing 1.9g of gelatin, so that the dispersed matter was prepared.

Layer 8: A highly sensitive layer of the blue-sensitive silver halide emulsion layer (BH-1)

This layer contains a dispersed matter prepared in a process that an emulsion comprising AgBrI containing Ag of 2 mol % thereof was blue-sensitized, and 0.9g of the resulted emulsion and 1.30g of the yellow coupler (Y-1) were dissolved in TCP, and then 0.65g of the resulted TCP solution were emulsified and dispersed in an aqueous solution containing 1.5 g of gelatin, so that the dispersed matter was prepared.

Layer 9: A protective layer (Pro)

This layer is a gelatin layer containing an emulsion-dispersed matter comprising 0.23g of gelatin, polymethyl methacrylate grains (of 2.5 μm in size) and the following UV absorbing agents, UV-1 and UV-2:

UV-1: 2-(2-benzotriazolyl)-4-t-pentylphenol

UV-2: 2-[3-Cyano-3-(n-dodecylaminocarbonyl)anilidene-1-ethylpyrrolidine

The Samples, No. 2-2 through No. 2-10, were prepared, respectively, in the same process as in Sample No. 2-1, except that the couplers shown in Table-22 were used therein to serve as the magenta couplers for GH-1 and GL-1 and a silver halide emulsions shown in the Table-22 were used, instead. (Besides the above, the grain size was changed to 0.8 μ for GL-1)

With respect to the resulted Samples, No. 2-1 through No. 2-10, both of those processed for 30 days under the conditions of 35° C. and 80%RH and those remained unprocessed each were wedgewise exposed to white light and developed as aforementioned, respectively.

TABLE 22

| | Sample No. | Emulsion | Magenta coupler | Unprocessed Fog | Unprocessed Sensitivity | Unprocessed Graininess (RMS) | Processed for 30 days, at 35° C., 80% RH Fog | Processed Sensitivity | Processed Graininess (RMS) |
|---|---|---|---|---|---|---|---|---|---|
| Comparative | 2-1 | EM-6 | Ex'fied comp'd 13 | 0.18 | 100 | 58 | 0.24 | 74 | 65 |
| | 2-2 | EM-9 | Ex'fied comp'd 13 | 0.18 | 102 | 57 | 0.23 | 77 | 67 |
| Invention | 2-3 | EM-4 | Ex'fied comp'd 13 | 0.13 | 161 | 48 | 0.13 | 160 | 48 |
| | 2-4 | EM-11 | Ex'fied comp'd 13 | 0.14 | 155 | 50 | 0.15 | 153 | 50 |
| | 2-5 | EM-14 | Ex'fied comp'd 4 | 0.15 | 155 | 50 | 0.16 | 155 | 51 |
| | 2-6 | EM-17 | Ex'fied comp'd 4 | 0.13 | 158 | 49 | 0.13 | 156 | 52 |
| | 2-7 | EM-20 | Ex'fied comp'd 4 | 0.15 | 155 | 48 | 0.15 | 154 | 50 |
| | 2-8 | EM-23 | Ex'fied comp'd 2 | 0.14 | 154 | 50 | 0.15 | 154 | 50 |
| | 2-9 | EM-28 | Ex'fied comp'd 2 | 0.15 | 156 | 51 | 0.16 | 153 | 53 |
| | 2-10 | EM-32 | Ex'fied comp'd 2 | 0.15 | 156 | 48 | 0.15 | 155 | 51 |

As is obvious from the above results, it is understood that, according to the invention, the stability on standing is excellent even under a high temperature condition and a high sensitivity and a high image quality can stably be obtained.

What is claimed is:

1. A silver halide photographic light-sensitive material having at least one silver halide emulsion layer, said silver halide emulsion layer comprising a magenta coupler represented by formula and negative type silver halide grains having a core-shell structure which consists of:

(a) an inner core consisting essentially of silver bromide or silver iodobromide; and (b) a plurality of shells consisting essentially of silver bromide or silver iodobromide, wherein said plurality of shells comprises:

(i) an outermost shell containing 0 to 10 mol % of silver iodide;

(ii) a high iodide-containing shell provided inside said outermost shell having a silver iodide content at least 6 mol % higher than that of said outermost shell; and (iii) an intermediate shell provided between said outermost shell and said high iodide-containing shell having a silver iodide content at least 3 mol % higher than that of said outermost shell, and at least 3 mol % lower than that of said high iodide-containing shell:

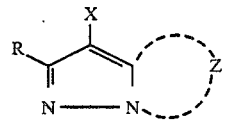

I wherein Z represents a group of non-metallic atoms necessary to complete a nitrogen-containing heterocyclic ring which may have a substituent, X represents a hydrogen atom, a halogen atom or a monovalent group which is, upon reaction with an oxidation product of a color developing agent, capable of being released from the coupler residue, and R represents a hydrogen atom, a halogen atom or a monovalent group.

2. The silver halide photographic light-sensitive material of claim 1, wherein said R represents a hydrogen atom, a halogen atom or a monovalent group selected from the group consisting of, an alkyl group, a cycloalkyl group, an alkenyl group, a cycloalkenyl group, an alkynyl group, an aryl group, a heterocyclic group, an acyl group, a sulfonyl group, a sulfinyl group, a carbamoyl group, a sulfamoyl group, a cyano group, a residue of a spyro compounds, a residue of bridged hydrocarbons, an alkoxy group, an aryloxy group, an heterocycloxy group, a siloxy group, an acyloxy group, a carbamoyloxy group, an amino group, an acylamino group, a sulfonamido group, an imido group, an ureido group, a sulfamoylamino group, an alkoxycarbonylamino group, an aryloxycarbonylamino group, an alkoxycarbonyl group, an aryloxycarbonyl group, an alkylthio group, an arylthio group, and a heterocyclic group.

3. The silver halide photographic light-sensitive material of claim 1, wherein said magenta coupler is represented by the general formula:

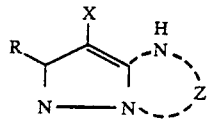

[XII]

wherein Z, X, R respectively represent the same atoms or groups as in Formula.

4. The silver halide photographic light-sensitive material of claim 3, wherein said magenta coupler is represented by the formula VI:

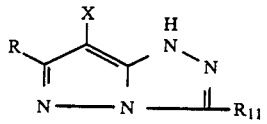

VI wherein R and $R_{11}$ are each selected from the same atoms or groups of R in formula I, and X is as defined in formula I.

5. The silver halide photographic light-sensitive material of claim 2, wherein R is represented by the formula:

$$R_{19}—CH_2— \quad \text{(XIII)}$$

wherein, $R_{19}$ represents a hydrogen atom or a monovalent group selected from the group consisting of a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a carbamoyl group, a sulfamoyl group, a cyano group, a residue of a spyro compounds a residue of bridged hydrocarbons, an alkoxy group, an aryloxy group, an heterocycloxy group, a siloxy group, an acyloxy group, a carbamoyloxy group, an amino group, an acylamino group, a sulfonamido group, an imido group, an ureido group, a sulfamoylamino group, an alkoxycarbonylamino group, an aryloxycarbonylamino group, an alkoxycarbonyl group, an aryloxycarbonyl group, an alkylthio group, arylthio group, and a heterocyclic group).

6. The silver halide photographic light-sensitive material of claim 5, wherein said $R_{19}$ is a hydrogen atom or an alkyl group.

7. The silver halide photographic light-sensitive material of claim 1, wherein the silver iodide content of said high iodide containing-shell is within the rang of 6 to 40 mol %.

8. The silver halide photographic light-sensitive material of claim 7, wherein the silver iodide content of said high iodide containing-shell is within the range of 10 to 40 mol %.

9. The silver halide photographic light-sensitive material of claim 1, wherein the silver iodide content of said outermost shell is within the range of 0 to 5 mol %.

10. The silver halide photographic light-sensitive material of claim 9, wherein the silver iodide content of said outermost shell is within the range of 0 to 2 mol %.

11. The silver halide photographic light-sensitive material of claim 10, wherein the silver iodide content of said outermost shell is within the range of 0 to 1 mol %.

12. The silver halide photographic light-sensitive material of claim 1, wherein the difference of the silver iodide content between said intermediate shell and said outermost shell is within the range of 4 to 35 mol %.

13. The silver halide photographic light-sensitive material of claim 1, wherein the difference of the silver iodide content between said high iodide-containing shell and said intermediate shell is within the range of 4 to 35 mol %.

14. The silver halide photographic light-sensitive material of claim 1, wherein the difference of the silver iodide content between said high iodide-containing shell and outermost shell is not less than 8 mol %.

15. The silver halide photographic light-sensitive material of claim 14, wherein the difference of the silver iodide content between said high iodide-containing shell and outermost shell is not less than 10 mol %.

16. The silver halide photographic light-sensitive material of claim 1, wherein silver iodide content of said inner core is within the range of 0 to 40 mol %.

17. The silver halide photographic light-sensitive material of claim 16, wherein silver iodide content of said inner core is within the range of 0 to 10 mol %.

18. The silver halide photographic light-sensitive material of claim 17, wherein silver iodide content of said inner core is within the range of 0 to 6 mol %.

19. The silver halide photographic light-sensitive material of claim 1, wherein a volume of said outermost shell is within the range of 4 to 70% of a whole volume of said silver halide grain.

20. The silver halide photographic light-sensitive material of claim 19, wherein the volume of said outermost shell is within the range of 10 to 50% of the whole volume of said silver halide grain.

21. The silver halide photographic light-sensitive material of claim 1, wherein a volume of said high iodide-containing shell is within the range of 10 to 80% of the whole volume of said silver halide grain.

22. The silver halide photographic light-sensitive material of claim 21, wherein the volume of said high iodide-containing shell is within the range of 20 to 50% of the whole volume of said silver halide grain.

23. The silver halide photographic light-sensitive material of claim 22, wherein the volume of said high iodide-containing shell is within the range of 20 to 45% of the whole volume of said silver halide grain.

24. The silver halide photographic light-sensitive material of claim 1, wherein a volume of said intermediate shell is within the range of 5 to 60% of the whole volume of said silver halide grain.

25. The silver halide photographic light-sensitive material of claim 24, wherein the volume of said intermediate shell is within the range of 20 to 55% of the whole volume of said silver halide grain.

26. The silver halide photographic light-sensitive material of claim 1, wherein a size of said inner core is within the range of 0.05 to 0.8 μm.

27. The silver halide photographic light-sensitive material of claim 26, wherein the size of said inner core is within the range of 0.05 to 0.4 μm.

28. The silver halide photographic light-sensitive material of claim 1, wherein a whole content of silver iodide of said silver halide grain is within the range of 1 to 20 mol %.

29. The silver halide photographic light-sensitive material of claim 28, wherein the whole content of silver iodide of said silver halide grain is within the range of 1 to 15 mol %.

30. The silver halide photographic light-sensitive material of claim 29, wherein the whole content of silver iodide of said silver halide grain is within the range of 2 to 12 mol %.

31. The silver halide photographic light-sensitive material of claim 1, wherein said silver halide grains are in a monodispersed state.

32. The silver halide photographic light-sensitive material of claim 31, wherein a variation coefficient representing a dispersed state of said silver halide grains, which is defined by the equation, is not more than 20%:

$$\text{variation coefficient (\%)} = \frac{\text{Standard deviation of grain size}}{\text{average grain size}} \times 100. \quad [A]$$

33. The silver halide photographic light-sensitive material of claim 32, wherein said variation coefficient is not more than 15%.

* * * * *

UNITED STATES PATENT AND TRADEMARK OFFICE

CERTIFICATE OF CORRECTION

PATENT NO. : 4,990,437

DATED : February 05, 1991

INVENTOR(S) : Toshifumi Iijama et al.

It is certified that error appears in the above-identified patent and that said Letters Patent is hereby corrected as shown below:

Title Page:

In the Abstract, Line 1, change "materially" to --material--;

Claim 3, Column 73, Line 35, change "Formula." to --formula I.--;

Claim 5, Column 73, Line 51, after "formula" insert --XIII--;

Signed and Sealed this

Thirteenth Day of April, 1993

*Attest:*

STEPHEN G. KUNIN

*Attesting Officer*

*Acting Commissioner of Patents and Trademarks*